US007820350B2

(12) United States Patent
Yamada et al.

(10) Patent No.: US 7,820,350 B2
(45) Date of Patent: Oct. 26, 2010

(54) TONER, DEVELOPER, TONER CONTAINER, PROCESS CARTRIDGE, IMAGE FORMING APPARATUS, AND IMAGE FORMING METHOD

(75) Inventors: Masahide Yamada, Numazu (JP); Shigeru Emoto, Numazu (JP); Naohiro Watanabe, Sunto-gun (JP); Masahiro Ohki, Numazu (JP); Akinori Saitoh, Numazu (JP); Shinichi Wakamatsu, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 851 days.

(21) Appl. No.: 11/687,372

(22) Filed: Mar. 16, 2007

(65) Prior Publication Data

US 2007/0218392 A1 Sep. 20, 2007

(30) Foreign Application Priority Data

Mar. 17, 2006 (JP) ..... 2006-074786

(51) Int. Cl.
*G03G 9/00* (2006.01)

(52) U.S. Cl. ..... 430/109.4; 430/123.5; 430/137.15

(58) Field of Classification Search ..... 430/109.4, 430/137.15, 123.5
See application file for complete search history.

(56) References Cited

U.S. PATENT DOCUMENTS 5,747,210 A 5/1998 Emoto et al.
6,221,549 B1 4/2001 Emoto et al.
6,395,443 B2 5/2002 Kuroda et al.
6,660,443 B2 12/2003 Sugiyama et al.
6,682,866 B2 1/2004 Sugiyama et al.
6,740,460 B2 5/2004 Tomita et al.
6,756,175 B2 6/2004 Emoto et al.

(Continued)

FOREIGN PATENT DOCUMENTS

EP 0 392 285 A2 10/1990

(Continued)

OTHER PUBLICATIONS

U.S. Appl. No. 12/026,937, filed Feb. 6, 2008, Seshita, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

A toner containing a colorant, and a binder resin, wherein the toner is prepared by dissolving or dispersing a colorant, a precursor of the binder resin having a site capable of reacting with an active hydrogen group-containing compound, the active hydrogen group-containing compound, in an organic solvent, to prepare a toner constituent mixture liquid, dispersing or emulsifying the toner constituent mixture liquid, in an aqueous medium while subjecting the precursor to a reaction with the active hydrogen group-containing compound, to prepare a toner dispersion, and removing the organic solvent from the toner dispersion; the binder resin contains a modified polyester having an isocyanate-derived binding site; the Sn content in the toner is 800 ppm or less; the content of a metal which is non Sn and derived from a polyesterified catalyst is 10 ppm to 200 ppm; and the content of a metal which is non Sn and derived from an isocyanated catalyst is 10 ppm to 200 ppm.

15 Claims, 7 Drawing Sheets

U.S. PATENT DOCUMENTS

| | | | |
|---|---|---|---|
| 6,787,280 | B2 | 9/2004 | Yamashita et al. |
| 6,800,412 | B2 | 10/2004 | Sugiyama et al. |
| 6,824,945 | B2 | 11/2004 | Emoto et al. |
| 6,835,519 | B2 | 12/2004 | Sugiyama et al. |
| 6,846,604 | B2 | 1/2005 | Emoto et al. |
| 6,849,369 | B2 | 2/2005 | Yagi et al. |
| 6,852,462 | B2 | 2/2005 | Emoto et al. |
| 6,936,390 | B2 | 8/2005 | Nanya et al. |
| 6,947,692 | B2 | 9/2005 | Kondo et al. |
| 7,005,223 | B2 | 2/2006 | Yamashita et al. |
| 7,056,635 | B2 | 6/2006 | Tanaka et al. |
| 7,056,636 | B2 | 6/2006 | Tomita et al. |
| 7,056,638 | B1 | 6/2006 | Tomita et al. |
| 7,083,890 | B2 | 8/2006 | Emoto et al. |
| 7,129,013 | B2 | 10/2006 | Higuchi et al. |
| 7,157,199 | B2 | 1/2007 | Emoto et al. |
| 7,157,201 | B2 | 1/2007 | Tomita et al. |
| 7,163,775 | B2 | 1/2007 | Takada et al. |
| 2003/0027066 | A1 | 2/2003 | Yamashita et al. |
| 2003/0055159 | A1 | 3/2003 | Yamashita et al. |
| 2003/0096185 | A1 | 5/2003 | Yamashita et al. |
| 2004/0131961 | A1 | 7/2004 | Watanabe et al. |
| 2004/0157146 | A1 | 8/2004 | Tomita et al. |
| 2004/0175641 | A1 | 9/2004 | Nanya et al. |
| 2004/0229147 | A1 | 11/2004 | Higuchi et al. |
| 2004/0265721 | A1 | 12/2004 | Matsuoka et al. |
| 2005/0008961 | A1 | 1/2005 | Takada et al. |
| 2005/0026066 | A1 | 2/2005 | Tanaka et al. |
| 2005/0031980 | A1 | 2/2005 | Inoue et al. |
| 2005/0042534 | A1 | 2/2005 | Tanaka et al. |
| 2005/0112488 | A1 | 5/2005 | Yamada et al. |
| 2005/0164112 | A1 | 7/2005 | Ohki et al. |
| 2005/0164114 | A1 | 7/2005 | Yagi et al. |
| 2005/0180786 | A1 | 8/2005 | Yamada et al. |
| 2005/0186498 | A1 | 8/2005 | Honda et al. |
| 2005/0277044 | A1 | 12/2005 | Watanabe et al. |
| 2005/0277045 | A1 | 12/2005 | Saito et al. |
| 2006/0046174 | A1 | 3/2006 | Ohki et al. |
| 2006/0057488 | A1 | 3/2006 | Inoue et al. |
| 2006/0063089 | A1 | 3/2006 | Tanaka et al. |
| 2006/0068312 | A1 | 3/2006 | Yamashita et al. |
| 2006/0099529 | A1 | 5/2006 | Tanaka et al. |
| 2006/0154168 | A1 | 7/2006 | Tomita et al. |
| 2006/0160011 | A1 | 7/2006 | Inoue et al. |
| 2006/0167214 | A1* | 7/2006 | Terauchi et al. ..... 528/272 |
| 2006/0204883 | A1 | 9/2006 | Nakayama et al. |
| 2006/0210903 | A1 | 9/2006 | Ohki et al. |
| 2006/0251979 | A1 | 11/2006 | Watanabe et al. |
| 2006/0292482 | A1 | 12/2006 | Yamashita et al. |

FOREIGN PATENT DOCUMENTS

| | | | |
|---|---|---|---|
| EP | 1 542 084 | A1 | 6/2005 |
| EP | 1 566 701 | A1 | 8/2005 |
| JP | 60-90344 | | 5/1985 |
| JP | 61-160759 | | 7/1986 |
| JP | 62-63940 | | 3/1987 |
| JP | 64-15755 | | 1/1989 |
| JP | 2-82267 | | 3/1990 |
| JP | 3-41470 | | 2/1991 |
| JP | 3-229264 | | 10/1991 |
| JP | 2537503 | | 7/1996 |
| JP | 9-34167 | | 2/1997 |
| JP | 11-49180 | | 2/1999 |
| JP | 2931899 | | 5/1999 |
| JP | 11-305486 | | 11/1999 |
| JP | 2004-49914 | | 2/2004 |
| JP | 2005-195684 | | 7/2005 |
| JP | 2005-350597 | | 12/2005 |
| WO | WO 03/075100 | A2 | 9/2003 |

OTHER PUBLICATIONS

U.S. Appl. No. 12/203,278, filed Sep. 3, 2008, Yamada, et al.
U.S. Appl. No. 12/209,583, filed Sep. 12, 2008, Seshita, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 12/046,011, filed Mar. 11, 2008, Nagatomo, et al.

* cited by examiner

TONER, DEVELOPER, TONER CONTAINER, PROCESS CARTRIDGE, IMAGE FORMING APPARATUS, AND IMAGE FORMING METHOD

BACKGROUND OF THE INVENTION

1. Field of the Invention

The present invention relates to a toner for developing electrostatic images in electrophotography, electrostatic recording, and electrostatic printing etc., a developer in which the toner is used, a toner container, a process cartridge, an image forming apparatus, and an image forming method.

2. Description of the Related Art

In image formation by electrophotography, generally, a latent electrostatic image is formed on a photoconductor which is produced using a photoconductive material by means of various units. Next, after the latent electrostatic image is produced using a developer, the image developed by the developer is transferred to paper etc, and then, the image formation is carried out by fixing the transferred image by heating, pressurizing, or solvent vapor.

Method of developing a latent electrostatic image is roughly classified into liquid developing using a liquid developer in which various pigments and dyes in a fine powder form are dispersed in an insulating organic liquid, and dry developing in which a dry developer (hereinafter may be referred to as "toner") in which a colorant such as carbon black is dispersed in a resin is used. Examples of methods for dry developing include cascade method, magnetic brush method, and powder cloud method. In recent years, the dry developing has been used widely.

For fixing method based on the dry developing, fixing an image using a heating roller is generally used for favorable energy efficiency of the heating roller. Moreover, in recent years, for saving energy by fixing a toner at low-temperature, there is a tendency that the heat energy required to be given to the toner at the time of fixing is low. In DSM (demand-side management) programs of the International Energy Agency (IEA) there is a project for procuring a technologies of the next generation copiers, and requirement specifications thereof have been disclosed. For a copier of 30 cpm (copies per minute) and more, saving a significant amount of energy as compared to the conventional copiers is required to be accomplished such that the stand-by time is 10 seconds or less, and power consumption during the stand-by time is 10 watts to 30 watts (varies depending on a copying speed). One of the methods for achieving the requirement is a method of improving a temperature response by achieving the volume of a fixing member with lower-heat such as the heating roller etc. However, this method is not sufficiently satisfactory.

To satisfy the requirement and minimize the stand-by time, lowering the fixing temperature of the toner, and lowering the toner-fixing temperature when the machine is in use are considered to be indispensable technical items (technical requirements) to be achieved. In order to deal with such a low-temperature fixing, attempts have been made to use a polyester resin having an excellent low-temperature fixing property and comparatively favorable heat-resistant storage stability, instead of a styrene-acrylic resin which has hitherto been used generally (refer to Japanese Patent Application Laid-open Publication (JP-A) No. 60-90344, JP-A No. 64-15755, JP-A No. 2-82267, JP-A No. 3-229264, JP-A No. 3-41470, and JP-A No. 11-305486). Moreover, with an object of improving the low temperature fixing property, an attempt to add a specific non-olefin crystalline polymer in a binder (refer to JP-A No. 62-63940), an attempt to use a crystalline polyester (refer to Japanese Patent No. 2931899) etc. have been proposed. However, it cannot be said that optimization is made regarding a molecular structure and a molecular weight of a polyester resin.

Moreover, even by using these hitherto known technologies, it is not possible to achieve the specifications of the DSM program, and a low-temperature fixing technology which is advanced further ahead of the field of the conventional technology is required to be established.

Given these factor, for the further low-temperature fixing, it becomes necessary to control heat properties of a resin. However, lowering of a glass transition temperature (Tg) excessively leads to degradation of the heat resistant preservability, and when the molecular weight is made smaller (reduced) and an F1/2 temperature of the resin is lowered excessively, it gives rise to a problem of lowering of hot-offset generation (occurrence) temperature. Therefore, no breakthrough has yet been made in achieving a toner having a high hot-offset generation (occurrence) temperature, and an excellent low-temperature fixing property by controlling the heat properties of the resin.

Next, methods for manufacturing a toner which is used in developing electrostatic images are generally classified into a grinding method and a polymerization method. In the grinding method, a colorant, a charge controlling agent, and an offset preventing agent etc. are dispersed uniformly by dissolving and mixing in a thermoplastic resin, and toner is manufactured by grinding and classifying a toner composition which is obtained. According to this grinding method, it is possible to manufacture a toner having excellent properties to some extent. However, there are limitations on selection of materials. In other words, the toner composition obtained by dissolving and mixing has to be such that it can be ground and classified by an economically viable apparatus. Due to this requirement, the toner composition which is dissolved and mixed has to be made sufficiently brittle. Therefore, practically, at the time of forming particles by grinding the toner composition, a particle diameter distribution over a wide range is formed easily, and when an attempt is made to achieve a copy image having a favorable resolution and gradation, a weight-average particle diameter has to be made small, and fine particles having a particle diameter 4 μm or less and coarse particles having a particle diameter of 15 μm or more have to be eliminated, thereby leading to a drawback of substantial lowering of a toner yield. Moreover, in the grinding method, it is difficult to disperse uniformly the colorant and the charge controlling agent etc. in a thermoplastic resin, and as a result of this, there is an adverse effect on a fluidity, a developing property, a durability, and an image quality, which is a drawback.

In recent years, in order to overcome problematic points in the grinding method, a toner manufacturing method by polymerization has been proposed and being implemented. For example, toner particles have been obtained by a suspension polymerization method and an emulsion polymerization coagulation method (refer to Japanese Patent No. 2537503). However, in these toner manufacturing methods, it has been difficult to manufacture a toner by using a polyester resin having a superior low-temperature fixing property.

To solve this problem, toners such as a toner in which a toner composed of a polymer resin is made spherical by using a solvent in water (refer to JP-A No. 9-34167), and a toner in which an isocyanate reaction is used (refer to JP-A No. 11-49180) have been proposed. However, none of the proposals has been able to give a satisfactory low-temperature fixing property and toner productivity.

Consequently, a toner and a toner-related technology which are capable of satisfying both the excellent low-temperature fixing property and an offset resistance property, and forming a favorable highly defined image have not yet been achieved, and an early provision of such toner and toner-related technology has been sought.

BRIEF SUMMARY OF THE INVENTION

An object of the present invention is to provide a toner which is capable of satisfying both the excellent low-temperature fixing property and the offset resistance efficiency, and forming a favorable highly defined image, a developer in which this toner is used, a toner container, a process cartridge, an image forming apparatus, and an image forming method.

As a result of studying zealously over and over again by inventors of the present invention to solve the above-mentioned issues, since a catalytic function of both a polymerization reaction (condensation polymerization) and an isocyanate modification reaction are exerted by using an Sn catalyst for a bisphenol polyester, there is a significant industrial merit that a it is not necessary to perform process of addition etc. of a new catalyst, according to a removal of catalyst by refining and reaction. However, a bisphenol polyester, due to a substantial molecular weight, leads to a problem that a constituent in the form of a gel is formed, which is substantially (almost) insoluble in an organic solvent such as ethyl acetate.

On the other hand, when an aliphatic polyhydric alcohol of mainly an ethylene glycol (EG)/polyethylene glycol (PG) is used, even if the substantial molecular weight constituent is formed, this substantial molecular weight constituent is readily soluble in an organic solvent for polyester of which ethyl acetate is a typical example, and the constituent in the form of a gel is not formed. Therefore, it is possible to form a toner composition having uniformity. Moreover, apart from this, from the point of view of polyester synthesis, an organic Sn catalyst which has been used so far for general purpose, is being sought to be replaced by other polymerization catalyst for social demands, particularly from point of view of environmental and health aspects. Regarding such EG/PG based substance, it is possible to let a polyesterization reaction to occur by using a polyesterified catalyst (such as Ti based catalyst and the like) which is non Sn, and not using the Sn-based catalyst. However, while the Sn-based catalyst has a function as a polymerization catalyst as well as a function of a catalyst for an isocyanation reaction, in case of the Ti-based catalyst, it is difficult to exert such multifunction as a catalyst, and an isocyanate modification reaction could not occur sufficiently.

Therefore, in the present invention, in EG/PG based (substance), by using an isocyanated catalyst (such as Bi-based catalyst and the like) which is a non Sn at the time of the isocyanate modification reaction after the polyesterization reaction, an increase in the molecular weight of the isocyanate modification polyester without turning into gel, which was difficult in the bisphenol based is made possible by using in a uniform oil phase.

The present invention is made based on findings by the inventors of the present invention, and means for solving the abovementioned issues are as follows. In other words, <1> A toner which contains a colorant, and a binder resin, wherein the toner is prepared by dissolving or dispersing at least a colorant, a precursor of the binder resin having a site capable of reacting with an active hydrogen group-containing compound, the active hydrogen group-containing compound, in an organic solvent, to prepare a toner constituent mixture liquid, dispersing or emulsifying the toner constituent mixture liquid, in an aqueous medium while subjecting the precursor to a reaction with the active hydrogen group-containing compound, to prepare a toner dispersion, and removing the organic solvent from the toner dispersion to prepare the toner; the binder resin comprises at least a modified polyester; the modified polyester is derived from the precursor which has an isocyanate-derived functional group; the Sn content in the toner is 800 ppm or less; the content of a metal which is non Sn and derived from a polyesterified catalyst is 10 ppm to 200 ppm; and the content of a metal which is non Sn and derived from an isocyanated catalyst is 10 ppm to 200 ppm.

<2> The toner according to the item <1>, wherein the Sn content in the toner is 0 ppm to 500 ppm, the content of the metal which is non Sn and derived from a polyesterified catalyst is 10 ppm to 200 ppm, and the content of the metal which is non Sn and derived from an isocyanated catalyst is 10 ppm to 200 ppm.

<3> The toner according to the item <1>, wherein the Sn content in the toner is 800 ppm or less, the Ti content in the toner is 10 ppm to 200 ppm, and the Bi content is 10 ppm to 200 ppm.

<4> The toner according to the item <3>, wherein the Sn content in the toner is 0 ppm to 500 ppm, the Ti content in the toner is 10 ppm to 200 ppm, and the Bi content in the toner is 10 ppm to 200 ppm.

<5> The toner according to the item <1>, wherein the binding site derived from the isocyanate group is at least any one of a urea bond and a urethane bond.

<6> The toner according to the item <1>, wherein the modified polyester comprises an isocyanate terminal modified polyester, and the isocyanate terminal modified polyester is prepared by reacting an unmodified polyester with a diisocyanate compound in the presence of an isocyanated catalyst which is non Sn.

<7> The toner according to the item <1>, wherein the unmodified polyester is polymerized using a polyesterified catalyst which is non Sn.

<8> The toner according to the item <6>, wherein the unmodified polyester comprises only an uncrosslinkable component.

<9> The toner according to the item <6>, wherein the isocyanate terminal modified polyester has a ratio (NCO/OH) of the number of OH groups of the unmodified polyester relative to the number of NCO groups of the diisocyanate compound is 2.0 to 2.5.

<10> The toner according to the item <1>, wherein the toner comprises a crosslinkable polyester.

<11> The toner according to the item <10>, wherein the crosslinkable polyester is formed by a reaction between the modified polyester and the active hydrogen group-containing compound.

<12> The toner according to the item <1>, wherein the toner comprises a binder resin which differs from the polymer having a site capable of reacting with at least the active hydrogen group-containing compound, and the glass transition temperature of the binder resin is 30° C. to 50° C.

<13> The toner according to the item <12>, wherein the binder resin has an acid value of 1 mg KOH/g to 30 mg KOH/g.

<14> The toner according to the item <1>, wherein the toner has a glass transition temperature of 40° C. to 70° C.

<15> The toner according to the item <1>, wherein the weight average particle diameter of the toner is 3 μm to 8 μm, and the ratio of the weight average particle diameter/number average particle diameter is 1.25 or less.

<16> A developer which contains a toner, wherein the toner is obtained by emulsifying or dispersing in an aqueous medium a solution or a dispersion in which toner materials containing an active hydrogen group-containing compound, a polymer having a site capable of reacting with the active hydrogen group-containing compound, and a colorant are dissolved or dispersed in an organic solvent while or after reacting the active hydrogen-containing compound with the polymer and removing the organic solvent; the polymer comprises at least a modified polyester; the modified polyester is derived from the precursor which has an isocyanate-derived functional group; the Sn content in the toner is 800 ppm or less; the content of a metal which is non Sn and derived from a polyesterified catalyst is 10 ppm to 200 ppm; and the content of a metal which is non Sn and derived from an isocyanated catalyst is 10 ppm to 200 ppm.

<17> A toner container filled with a toner, wherein the toner is obtained by emulsifying or dispersing in an aqueous medium a solution or a dispersion in which toner materials containing an active hydrogen group-containing compound, a polymer having a site capable of reacting with the active hydrogen group-containing compound, and a colorant are dissolved or dispersed in an organic solvent while or after reacting the active hydrogen-containing compound with the polymer and removing the organic solvent; the polymer comprises at least a modified polyester; the modified polyester is derived from the precursor which has an isocyanate-derived functional group; the Sn content in the toner is 800 ppm or less; the content of a metal which is non Sn and derived from a polyesterified catalyst is 10 ppm to 200 ppm; and the content of a metal which is non Sn and derived from an isocyanated catalyst is 10 ppm to 200 ppm.

<18> A process cartridge which includes a latent electrostatic image bearing member; and a developing unit configured to develop a latent electrostatic image formed on the latent electrostatic image bearing member using a toner to form a visible image, and wherein the toner is obtained by emulsifying or dispersing in an aqueous medium a solution or a dispersion in which toner materials containing an active hydrogen group-containing compound, a polymer having a site capable of reacting with the active hydrogen group-containing compound, and a colorant are dissolved or dispersed in an organic solvent while or after reacting the active hydrogen-containing compound with the polymer and removing the organic solvent; the polymer comprises at least a modified polyester; the modified polyester is derived from the precursor which has an isocyanate-derived functional group; the Sn content in the toner is 800 ppm or less; the content of a metal which is non Sn and derived from a polyesterified catalyst is 10 ppm to 200 ppm; and the content of a metal which is non Sn and derived from an isocyanated catalyst is 10 ppm to 200 ppm.

<19> An image forming apparatus which includes a latent electrostatic image bearing member, a latent electrostatic image forming unit configured to form a latent electrostatic image on the latent electrostatic image bearing member, a developing unit configured to develop the latent electrostatic image using a toner to form a visible image, a transferring unit configured to transfer the visible image onto a recording medium; and a fixing unit configured to fix the transferred image on the recording medium, wherein the toner is obtained by emulsifying or dispersing in an aqueous medium a solution or a dispersion in which toner materials containing an active hydrogen group-containing compound, a polymer having a site capable of reacting with the active hydrogen group-containing compound, and a colorant are dissolved or dispersed in an organic solvent while or after reacting the active hydrogen-containing compound with the polymer and removing the organic solvent; the polymer comprises at least a modified polyester; the modified polyester is derived from the precursor which has an isocyanate-derived functional group; the Sn content in the toner is 800 ppm or less; the content of a metal which is non Sn and derived from a polyesterified catalyst is 10 ppm to 200 ppm; and the content of a metal which is non Sn and derived from an isocyanated catalyst is 10 ppm to 200 ppm.

<20> An image forming method which includes forming a latent electrostatic image on a latent electrostatic image bearing member, developing the latent electrostatic image using a toner to form a visible image, transferring the visible image onto a recording medium, and fixing an image which is transferred to the recording medium, wherein the toner is obtained by emulsifying or dispersing in an aqueous medium a solution or a dispersion in which toner materials containing an active hydrogen group-containing compound, a polymer having a site capable of reacting with the active hydrogen group-containing compound, and a colorant are dissolved or dispersed in an organic solvent while or after reacting the active hydrogen-containing compound with the polymer and removing the organic solvent; the polymer comprises at least a modified polyester; the modified polyester is derived from the precursor which has an isocyanate-derived functional group; the Sn content in the toner is 800 ppm or less; the content of a metal which is non Sn and derived from a polyesterified catalyst is 10 ppm to 200 ppm; and the content of a metal which is non Sn and derived from an isocyanated catalyst is 10 ppm to 200 ppm.

It is preferable that the toner according to the present invention is obtained by emulsifying or dispersing in an aqueous medium a solution or a dispersion (dispersing liquid) in which, at least an active hydrogen group-containing compound, a polymer having a site which is capable of reacting with the active hydrogen group-containing compound, and a toner material containing a colorant are dissolved or dispersed in an organic solvent, and while allowing or after allowing the active hydrogen group-containing compound and the polymer to react, the organic solvent is removed; the polymer contains at least a modified polyester, and the modified polyester has a binding site derived from an isocyanate group; the Sn content in the toner is 800 ppm or less, the content of a metal which is non Sn and derived from a polyesterified catalyst is 10 ppm to 200 ppm, and the content of a metal which is non Sn and derived from an isocyanated catalyst is 10 ppm to 200 ppm.

In the toner according to the present invention, by providing the abovementioned composition, it is possible to have both an excellent low-temperature fixing property and the offset resistance property, and to form a favorable highly defined image.

The developer according to the present invention contains the toner according to the present invention. Therefore, when an image formation is carried out by electrophotography by using the developer, it is possible to have both the excellent fixing property and the offset resistance property, and to achieve a highly defined image.

The toner container according to the present invention contains the toner according to the present invention in a receptacle. Therefore, when the image formation is carried out by the electrophotography by using the toner contained in the toner container, it is possible to have both the excellent fixing property and the offset resistance property, and to achieve a favorable highly defined image.

The process cartridge according to the present invention includes at least the latent electrostatic image bearing member, and a developing unit configured to develop the latent electrostatic image formed on the latent electrostatic image bearing member by using the toner, and forms the visible image. The process cartridge is detachable from the image forming apparatus, and is extremely convenient. Moreover, since the toner according to the present invention is used (in the process cartridge), it is possible to have both the excellent low-temperature fixing property and the offset resistance property, and to achieve a highly defined image.

The image forming apparatus according to the present invention includes at least the latent electrostatic image bearing member, the latent electrostatic image forming unit, the developing unit, the transferring unit, and the fixing unit. In the image forming apparatus, the latent electrostatic image forming unit forms the latent electrostatic image on the latent electrostatic image bearing member. The developing unit develops the latent electrostatic image by using the toner according to the present invention, and forms the visible image. The transferring unit transfers the visible image to the recording medium. The fixing unit fixes the image which is transferred to the recording medium. As a result of this, it is possible to have both the excellent low-temperature fixing quality and the offset resistance property, and to form a highly defined electrophotographic image.

The image forming method according to the present invention includes at least forming, developing, transferring, and fixing. In the image forming method, in the forming, the latent electrostatic image is formed on the latent electrostatic image bearing member. In the developing, the latent electrostatic image is developed by using the toner according to the present invention, and the visible image is formed. In the transferring, the visible image is transferred to the recording medium. In the fixing, the image which is transferred to the recording medium is fixed. As a result of this, it is possible to have both the excellent low-temperature fixing property and the offset resistance property, and to form a highly defined electrophotographic image.

DETAILED DESCRIPTION OF THE INVENTION (Toner)

Figure 1:
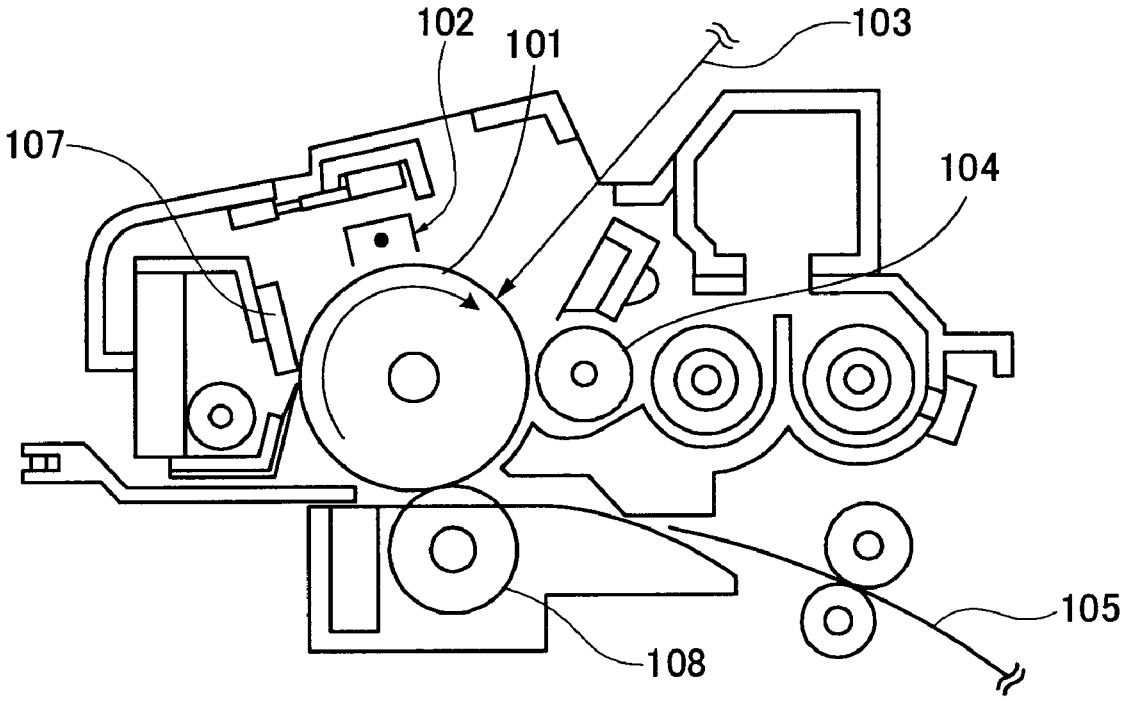
FIG. 1 is a schematic structural view showing an example of a process cartridge of the present invention.

A toner according to the present invention is obtained by emulsifying or dispersing in an aqueous medium a solution or a dispersion in which toner materials containing an active hydrogen group-containing compound, a polymer having a site capable of reacting with the active hydrogen group-containing compound, and a colorant are dissolved or dispersed in an organic solvent while or after reacting the active hydrogen-containing compound with the polymer and removing the organic solvent.

Sn in the toner is derived from a polymerization catalyst of a binder resin which differs from the polymer having a site which is capable of reacting with the active hydrogen group-containing compound, and an Sn content is 800 ppm or less, and the Sn content in a range of 0 ppm to 500 ppm is preferable. Thus, decreasing the Sn content to the possible extent is in accordance with social needs.

A content of a metal derived from a polyesterified catalyst which is non Sn is 10 ppm to 200 ppm, and a range of 100 ppm to 200 ppm is preferable. When the content is less than 10 ppm, a polymerization reaction of polyester may be insufficient, and when the content is more than 200 ppm, it is economically disadvantageous (not viable economically).

Examples of polyesterified catalyst which is non Sn are, Ti-based catalysts, Sb-based catalysts, and Al-based catalysts, and the like, and the Ti-based catalysts are particularly preferable. A Ti content in a range of 10 ppm to 200 ppm in the toner when the Ti based catalyst is used is preferable, and the Ti content in a range of 100 ppm to 200 ppm is more preferable.

A content of a metal which is non Sn and derived from an isocyanated catalyst is 10 ppm to 200 ppm, and the content in a range of 100 ppm to 200 ppm is preferable. When the content is less than 10 ppm, an isocyanate-addition reaction may be insufficient, when the content is more than 200 ppm, it is economically disadvantageous (not viable economical).

Examples of isocyanation catalyst which is non Sn are Bi-based catalysts and Zr-based catalysts, and the like, and Bi-based catalysts are particularly preferable. A Bi content in a range of 10 ppm to 200 ppm in the toner when the Bi-based catalyst is used is preferable, and the Bi content in a range of 100 ppm to 200 ppm is more preferable.

It is possible to measure the content of the metal (such as Sn, Bi, Ti and the like) derived from the catalyst in the toner by an X-ray fluorescence measuring instrument.

Concretely, a calibration curve is prepared by an X-ray fluorescent analyzer by using toner base particles having a known content of an inorganic compound; and by using this calibration curve, the content of the inorganic compound in the toner base-particles is determined by an X-ray fluorescence analysis method. It is possible to measure by using ZSX-100E X-ray fluorescence spectrometer manufactured by Rigaku Corporation, as the X-ray fluorescence analyzer. Moreover, when there are two or more types of inorganic compounds which are used, a sum of analytical values of the inorganic compounds was let to be the content of the inorganic compound in the toner base-particles.

It is preferable that the polymer which has the site capable of reacting with the active hydrogen group-containing compound includes at least a modified polyester, the modified polyester has a binding site derived from an isocyanate group, and the binding site derived from the isocyanate group is at least any one of a urea bond and a urethane bond. Accordingly, the modified polyester reacts with the active hydrogen group-containing compound, and a crosslinkable polyester is formed.

The isocyanate terminal modified polyester is prepared by reacting an unmodified polyester with a diisocyanate compound in the presence of an isocyanated catalyst (such as a Bi-based catalyst) which is non Sn.

For example, NEOSTANN U-600 manufactured by NITTO KASEI CO., LTD, is an example of the Bi-based catalyst.

There is no restriction in particular on an amount to be used of the Bi-based catalyst, and the amount to be used can be selected according to an object. However an amount in a range of 0.1 parts by mass to 1.0 part by mass for 100 parts by mass of the unmodified polyester is preferable.

The unmodified polyester is obtained by performing a condensation polymerization of an acid component and at least one type of a diol compound selected from aliphatic diols and alicyclic diols, in the presence of the polyesterified catalyst (such as Ti-based catalyst) which is non Sn.

Examples of a diol compound are 1,4-butanediol, propylene glycol, ethylene glycol, diethylene glycol, neopentyl glycol, 1,6-hexanediol, and the like. One type of diol compound may be used singly, or may be used in combination of two or more.

As the acid component, at least one of terephthalic acid and isophthalic acid is suitable.

Titanium tetrabutoxide is an example of the Ti-based catalyst. There is no restriction in particular on an amount to be used of the Ti-based catalyst, and the amount to be used can be selected appropriately according to an object.

There is no restriction in particular on a mixing ratio at the time of performing the condensation polymerization of the diol compound and the acid component, and the mixing ratio can be selected appropriately according to an object. However, it is preferable that generally an equivalent ratio of a hydroxyl group [OH] in the diol compound and a carboxyl group [COOH] in the acid component is 2/1 to 1/1. It is more preferable that the equivalent ratio is 1.5/1 to 1/1, and the equivalent ratio in a range of 1.3/1 to 1.02/1 is particularly preferable.

From a point of view of an NCO addition reaction, it is preferable that the unmodified polyester is made of only non cross-linked component.

An example of the modified polyester resin prepared by modifying a non modified polyester by a diisocyanate compound, which is particularly suitable is a polyester prepolymer (A) containing an isocyanate group.

The polyester prepolymer containing the isocyanate group is not restricted in particular, and can be selected appropriately according to an object. An example is a compound which is obtained by allowing to react with a polyisocyanates (PIC), a polyester resin which is obtained by performing condensation polymerization of the acid component and at least one type of diol compound selected from the aliphatic diols and the alicyclic diols, in the presence of a catalyst.

The polyisocyanate (PIC) is not restricted in particular, and can be selected appropriately according to an object. Examples of the polyisocyanate are aliphatic polyisocyanates, alicyclic polyisocyanates, aromatic diisocyanates, aromatic-aliphatic diisocyanates, isocyanurates, compounds thereof blocked by phenols, oxime, caprolactum, and the like.

Examples of the aliphatic polyisocynate are tetramethylene diisocyanate, hexamethylene diisocyanate, 2,6-diisocyanate methyl caproate, octamethylene diisocyanate, decamethylene diisocyanate, dodecamethylene diisocyanate, tetradecamethylene diisocyanate, trimethyl hexane diisocyanate, and tetramethyl hexane diisocyanate. Examples of the alicyclic polyisocyanates are isophorone diisocyanate and cyclohexyl methane diisocyanate. Examples of the aromatic diisocyanate are tolylene diisocyanate, diphenyl methane diisocyanate, 1,5-naphthylene diisocyanate, diphenylene 4,4'-diisocyanate, 4,4'-diisocyanate-3,3'-dimethyl diphenyl, 3-methyl diphenyl methane-4,4'-diisocyanate, diphenyl ether-4,4'-diisocyanate, and the like. Examples of the aromatic-aliphatic diisocyanate are $\alpha,\alpha,\alpha',\alpha'$-tetramethyl xylene diisocyanate, and the like. Examples of the isocyanurate are tris-isocyanate alkyl-isocyanurate, tri-isocyanate cycloalkyl isocyanurate, and the like. These compounds can be used singly or may be used in combination of two or more of them.

As a blend ratio (mixing proportion) at the time of allowing the polyisocyanates (PIC) and the unmodified polyester resin, it is preferable that the equivalent ratio of mixing (blending) ([NCO]/[OH]) the isocyanate group [NCO] in the polyisocyanate (PIC) and the hydroxyl group [OH] in the polyester resin is generally in a range of 2.0 to 2.5. When the ratio ([NCO]/[OH]) is less than 2.0, a monofunctional prepolymer is formed, and due to a lack of an extension reaction, the offset resistance property may be insufficient. When the ratio ([NCO}/[OH]) is more than 2.5, there is an increase in NCO monomer, and a durability of the toner may be declined.

A content of the polyisocyanate (PIC) in the polyester prepolymer (A) containing the isocyanate group is not restricted particularly, and can be selected appropriately according to an object. However, the content in a range of 0.5 percent by mass to 40 percent by mass is preferable. A range of 1 percent by mass to 30 percent by mass is more preferable, and a range of 2 percent by mass to 20 percent by mass is even more preferable.

When the content of the polyisocyanate (PIC) is less than 0.5 percent by mass, the offset resistance property is degraded, and it may be difficult to have both a heat-resistant storage stability and the low-temperature fixing property. When the content of the polyisocyanate (PIC) is more than 40 percent by mass, the low-temperature fixing property may be declined.

It is preferable that a percentage content of the isocyanate base in the modified polyester resin according to JIS K1603 is 2.0 percent by mass or less, and the percentage content of the isocyanate base in a range of 1.0 percent by mass to 2.0 percent by mass is more preferable. When a percentage content of a free isocyanate group is more than 2.0 percent by mass, the low-temperature fixing property may not be exhibited. Here, it is possible to measure the percentage content of the free isocyanate group (NCO %) by a method according to JIS K1603 for example.

It is preferable that a weight-average molecular weight of the modified polyester resin is 10000 to 100000, and a range of 10000 to 50000 is more preferable. When the weight-average molecular weight of the modified polyester resin is less than 10000, the low-temperature fixing property may not be exhibited, and when the weight-average molecular weight of the modified polyester resin is more than 100000, a viscosity becomes excessively high, and the palletizing (granulation) may become difficult.

Here, it is possible to measure the weight-average molecular weight by a molecular weight distribution measurement by a GPC (gel permeation chromatography) of a soluble part of tetrahydrofuran (THF), as described below.

First of all, a column is stabilized in a heat chamber of 40° C. At this temperature, as a column solvent, tetrahydrofuran is allowed to flow at a flow velocity of 1 ml per minute. 50 μl to 200 μl of a sample solution of tetrahydrofuran of a resin in which a sample concentration is adjusted to be in a range of 0.05 percent by mass to 0.6 percent by mass is poured, and the measurement is carried out. Regarding the measurement of the molecular weight in the sample, the molecular weight distribution of the samples is calculated from a relationship between a count number and a logarithmic value of a calibration curve which is made by several types of monodispersed polystyrene standard samples. As the standard polystyrene samples for making the calibration curve, it is preferable to use polystyrene samples manufactured by Pressure Chemical Co., or Toyo Soda Industries Ltd. having the molecular weight $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$, and to use at least about 10 standard polystyrene samples. As a detector, an RI (refractive index) detector can be used.

It is preferable that a glass transition temperature (Tg) of the modified polyester resin is 10° C. to 50° C., and a range of 30° C. to 50° C. is more preferable.

It is preferable that a hydroxyl value of the modified polyester resin is 30 mg KOH/g or less, and the hydroxyl value in a range of 10 mg KOH/g to 25 mg KOH/g is more preferable.

It is preferable that an acid value of the modified polyester resin is 0 mg KOH/g to 10 mg KOH/g, and a range of 0 mg KOH/g to 5 mg KOH/g is more preferable.

Here, the acid value and the hydroxyl value can be measured by a method regulated by JIS K0070.

Here, the modified polyester resin is obtained by placing the diol compound, the acid component, and the polyesterified catalyst (such as Ti-based catalyst) which is non Sn, in a reaction vessel which is equipped with a cooling tube, a stirrer, and a nitrogen feeding tube, and allowed to react for eight hours at 230° C. under normal pressure. Next, the mixture is allowed to react for five hours at a reduced pressure of 10 mm Hg to 15 mm Hg, and further allowed to react in the presence of the compound having the isocyanate group and an isocyanated catalyst (such as Bi-based catalyst) which is non Sn.

Next, as a toner material, it is possible to use a material which includes at least an adhesive base material obtained by allowing to react at least an active hydrogen group-containing compound, and the modified polyester resin which is a polymer capable of reacting with the active hydrogen group-containing compound, and further includes a binder resin which differs from the polymer having a site capable of reacting with the active hydrogen group-containing compound, a colorant, and furthermore a releasing agent, fine particles of resin, a charge controlling agent, and other constituents.

—Adhesive Base Material—

It is preferable that the adhesive base material shows an adhesion property with respect to a recording medium such as paper, and includes at least an adhesive polymer which is obtained by allowing to react in an aqueous medium, the active hydrogen group-containing compound, and the modified polyester resin which is a polymer capable of reacting with the active hydrogen group-containing compound, and further includes a binder resin which differs from the polymer having a site capable of reacting with the active hydrogen group-containing compound.

The weight-average molecular weight of the adhesive base-material is not restricted in particular, and can be selected appropriately according to an object. It is preferable that the weight-average molecular weight of the adhesive base material is 1000 or more. It is more preferable that the weight-average molecular weight of the adhesive base material is 2000 to 10,000,000, and a range of 3000 to 1,000,000 is particularly preferable.

When the weight-average molecular weight is less than 1000, the offset resistance property may be declined.

—Compound Having Active Hydrogen Group—

The active hydrogen group-containing compound acts as an extension agent and a cross-linking agent at the time of the extension reaction and a cross-linking reaction by the modified polyester resin, which is a polymer capable of reacting with the active hydrogen group-containing compound.

The active hydrogen group-containing compound is not restricted in particular provided that the active hydrogen group-containing compound has an active hydrogen group, and can be selected appropriately according to an object. For example, when the modified polyester resin which is a polymer capable of reacting with the active hydrogen group-containing compound is a polyester prepolymer (A) containing the isocyanate group, amines (B) are suitable from a point of a possibility of having a high molecular weight (possibility of an increase in the molecular weight) by the extension reaction and the cross-linking reaction with the polyester prepolymer (A) containing the isocyanate group.

The active hydrogen group is not restricted in particular, and can be selected appropriately according to an object. Examples of the active hydrogen group are a hydroxyl group (alcoholic hydroxyl group or phenolic hydroxyl group) an amino group, a carboxyl group, and a mercapto group. These may be used singly, or in combination of more than one. Among these, the alcoholic hydroxyl group is particularly preferable.

The amines (B) are not restricted in particular, and can be selected appropriately according to an object. Examples of amines (B) are diamines (B1), trivalent or more than trivalent polyamines (B2), amino alcohols (B3), amino mercaptans (B4), amino acids (B5), compounds (B6) in which, the amine groups from B1 to B5 mentioned above are blocked, and the like.

These may be used singly or in combination of two or more. Among these, the diamines (B1) and mixtures of a diamine and a small amount of a trivalent or more than trivalent polyamine (B2) are particularly preferable.

Examples of diamines (B1) are aromatic diamines, alicyclic diamines, aliphatic diamines, and the like. Examples of the aromatic diamine are phenylene diamine, diethyltouenediamine, 4,4'diaminophenylmethane, and the like. Examples of the alicyclic diamine are 4,4'-diamino-3,3'dimethyldicyclohexylmethane, diamine cyclohexane, isophorone diamine, and the like. Examples of the aliphatic diamine are ethylene diamine, tetramethyl diamine, hexamethyl diamine, and the like.

Examples of the trivalent or more than trivalent polyamine (B2) are diethylene triamine, triethylene tetramine, and the like.

Examples of the amino alcohol (B3) are ethanolamine, hydroxyethylaniline, and the like.

Examples of the amino mercaptan (B4) are aminoethylmercapton, aminopropylmercaptan, and the like.

Examples of the amino acid (B5) are aminopropionic acid, aminocaproic acid, and the like.

Examples of the compound (B6) in which the amine groups B1 to B5 mentioned above are blocked are ketimine compounds and oxazolizone compounds obtained from ketones (such as acetone, methyl ethyl ketone, and methyl isobutyl ketone), any of the amines mentioned in (B1) to (B5), and the like.

A reaction inhibitor can be used for stopping the extension reaction and the cross-linking reaction between the active hydrogen group-containing compound and the modified polyester resin which is a polymer capable of reacting with the active hydrogen group-containing compound. When the reaction inhibitor is used, it is preferable from a point that it is possible to control the molecular weight of the adhesive base-material in a desired range. Examples of the reaction inhibitor are monoamines (such as diethylamine, dibutylamine, butyl amine, and laurylamine), or compounds (ketimine compounds) in which these monoamines are blocked.

As a blend ratio (mixing proportion) of the amine (B) and the polyester prepolymer (A) containing the isocyanate group, it is preferable that the equivalent ratio of mixing (blending) ([NCO]/[NHx]) the isocyanate group [NCO] in the prepolymer containing the isocyanate group and an amino group [NHx] in the amine (B) is 1/3 to 3/1. The ratio in a range of 1/2 to 2/1 is more preferable, and the ratio in a range of 1/1.5 to 1.5/1 is particularly more preferable.

When the equivalent ratio of mixing ([NCO]/[NHx]) is less than 1/3, the low-temperature fixing property may be declined, and when the equivalent ratio of mixing ([NCO]/[NHx]) is more than 3/1, the molecular weight of a urea modified polyester resin becomes low, and the offset resistance property may be declined.

—Binder Resin which Differs from Polymer Having Site Capable of Reacting with Compound Having Active Hydrogen Group—

The binder resin which differs from the polymer having the site capable of reacting with the compound having the active hydrogen is not restricted in particular, and can be selected appropriately according to an object. An example of the binder resin is a polycondensate of a polyol (PO) and a polycarboxylic acid (PC).

It is preferable that the weight-average molecular weight (Mw) of the binder resin which differs from the polymer having the site capable of reacting with the active hydrogen group-containing compound, by (in terms of) the molecular weight distribution (measurement) by the GPC of the soluble part of the tetrahydrofuran (THF) is 1000 to 30000, and a range of 1500 to 15000 is more preferable. When the weight-average molecular weight is less than 1000, the heat-resistant storage stability may be declined. Therefore, it is necessary that a content of the component having the weight-average molecular weight (Mw) less than 1000 is 8 percent by mass to 28 percent by mass. On the other hand, when the weight-average molecular weight (Mw) is more than 30000, the low-temperature fixing property may be declined.

It is preferable that the glass transition temperature of the binder resin which differs from the polymer having the site capable of reacting with the active hydrogen group-containing compound is 30° C. to 50° C. When the glass transition temperature is more than 30° C., the heat-resistant storage stability of the toner is declined, and when the glass transition temperature is more than 50° C., the low-temperature fixing property may be insufficient.

It is preferable that a hydroxyl value of the binder resin which differs from the polymer having the site capable of reacting with the active hydrogen group-containing compound is 5 mg KOH/g or more. The hydroxyl value of the binder resin in a range of 10 mg KOH/g to 120 mg KOH/g is more preferable, and a range of 20 mg KOH/g to 80 mg KOH/g is even more preferable. When the hydroxyl value is less than 5 mg KOH/g, it may be difficult to achieve both the heat-resistant storage stability and the low-temperature fixing property together.

It is preferable that an acid value of the binder resin which differs from the polymer having the site capable of reacting with the active hydrogen group-containing compound is 1.0 mg KOH/g to 30.0 mg KOH/g. Generally, by letting the toner to have the acid value, the toner is susceptible to have negative charging ability.

—Method for Measuring Acid Value—

The acid value is measured under the following conditions, based on a measurement method described in JIS K0070-1992.

Sample preparation: 0.5 g (0.3 g in ethyl acetate soluble element (part)) of toner is added to 120 ml of toluene at room temperature (23° C.), and is dissolved by stirring for approximately 10 hours. Further, 30 ml of ethanol is added, and this mixture is let to be a sample solution.

Although the measurement can be done by calculating by an instrument mentioned above, concretely the calculation is carried out in the following manner. A titration is carried out by an N/10 standardized caustic potash alcohol solution in advance, and the acid value is determined (calculated) from an amount consumed of an alcohol potassium liquid, by the following calculation expression (formula).

$$\text{Acid value}=\text{KOH(ml number)}\times N\times 56.1/\text{sample mass}$$

(where, N is a factor of N/10 KOH).

—Method for Measuring Hydroxyl Value—

First, 0.5 g of a sample is weighted precisely in a 100 ml measuring flask, and 5 ml of an acetylation reagent is added correctly to this sample. After this, the mixture is immersed in a bath of temperature 100° C.±5° C., and heated. After one to two hours, the flask is removed from the bath. Water is added after leaving the mixture in the flask to cool down, and acetic anhydride is decomposed by shaking. Next, to decompose completely, the flask is once again heated in the bath for 10 minutes or more, and after leaving the flask for cooling down, a wall of the flask is washed properly by an organic solvent. This liquid is subjected to a potentiometric titration by N/2 potassium hydroxide ethyl alcohol solution, by using an electrode, and the hydroxyl value is determined (according to JIS K0070-1966).

When the binder resin which differs from the polymer having the site capable of reacting with the active hydrogen group-containing compound is to be included in the toner, it is preferable that a mass ratio of a mixture of the modified polyester component and the binder resin is 5/95 to 25/75, and it is more preferable that the mass ratio is 10/90 to 25/75.

When the mass ratio of the mixture of the binder resin is more than 95, the offset resistance is degraded, and it may become difficult to have both the heat-resistant storage stability and the low-temperature fixing property together. When the mass ratio of the mixture of the binder resin is less than 25, the gloss property is declined.

—Colorant—

The colorant is not restricted in particular, and can be selected appropriately according to an object, from dyes and pigments which are heretofore known. Examples of the colorant are carbon black, nigrosine dye, iron black, naphthol yellow S, hanza yellow (10 G, 5 G, and G), cadmium yellow, yellow iron oxide, ocher (Chinese yellow), chrome yellow, titan yellow, polyazo yellow, oil yellow, hanza yellow (GR, A, RN, R), pigment yellow L, benzidine yellow (G, GR), permanent yellow (NCG), vulcun fast yellow (5G and R), tartrazine lake, quinoline yellow lake, anthrazan yellow BGL, isoindolinone yellow, bengala (Indian red), red lead (primer), vermilion red, cadmium red, cadmium mercury red, antimony red, permanent red 4R, para red, fire red, p-chloro o-nitro aniline red, lithol fast scarlet G, brilliant fast scarlet, brilliant carmine BS, permanent red (F2R, F4R, FRL, FRLL, and F4RH), fast scarlet VD, vulcun fast rubin B, brilliant scarlet G, lithol rubin GX, permanent red F5R, brilliant carmine 6B, pigment scarlet 3B, bordeaux 5B, toluedine maroon, permanent bordeaux F2K, helio bordeaux BL, bordeaux 10B, bon maroon light, bon maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulian blue, alkali blue lake, peacock blue lake, victoria blue lake, metal-free phthalocyanine blue, phthalocyanine blue, fast sky blue, indanthrene blue (RS and BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, Chinese white (zinc oxide), lithopone, and the like. These colorants may be used singly or may be used in combination of more than one.

A content of the colorant in the toner is not restricted in particular, and can be selected appropriately according to an object. However, it is preferable that the content of the colorant in the toner is 1 percent by mass to 15 percent by mass, and a range of 3 percent by mass to 10 percent by mass is more preferable.

When the content of the colorant in the toner is less than 1 percent by mass, a degradation of a tinting strength of the toner is observed, and when the content of the colorant in the toner is more than 15 percent by mass, there occurs to be a defective dispersion of pigments of the toner, and may lead to the degradation of the tinting strength and a degradation of electrical properties of the toner.

The colorant may be used as a master batch combined with a resin. The resin is not restricted in particular, and can be selected appropriately from among the heretofore known resins, according to an object. Examples of the resin are styrene and polymers of substitutes of styrene, styrene-based copolymers, polymethyl methacrylate, polybutyl methacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic hydrocarbon resins, alicyclic hydrocarbon resins, aromatic petroleum resins, chlorinated paraffins, paraffin, and the like. These may be used singly, or may be used in combination of two or more of them.

Examples of styrene or polymers of substitutes of styrene are polyester resins, polystyrene, poly-p-chlorostyrene, polyvinyl toluene, and the like. Examples of styrene-based copolymers are styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleate ester copolymers, and the like.

The master batch can be prepared by mixing or kneading resins for the master batch and the colorants under high shearing force. At the time of preparing the master batch, it is preferable to add an organic solvent in order to improve an interaction between the colorant and the resin. Moreover, a so-called flushing method can use a wet cake of the colorant as it is, and it is preferable since there is no need to carry out drying. The flushing method is a method of removing the water (moisture) and an organic-solvent component by mixing or kneading an aqueous paste which includes a water of the colorant with a resin and an organic solvent, and then shifting the colorant to the resin side. For mixing or kneading, a high-shear dispersing device such as a three-roll mill is preferably used.

—Other Components—

The other components are not restricted in particular, and can be selected appropriately according to an object. Examples of the other components are a releasing agent, a charge controlling agent, inorganic fine particles, a fluidity improving agent, a cleaning ability improving agent, a magnetic material, a metallic soap, and the like.

The releasing agent is not restricted in particular, and can be selected appropriately from hitherto known releasing agents, according to an object. Preferable examples of the releasing agent are wax, and the like.

Examples of wax are waxes containing a carbonyl group, polyolefin wax, long-chain hydrocarbon waxes, and the like. These may be used singly or may be used in combination of two or more. Among these waxes, the waxes containing the carbonyl group are preferable.

Examples of the wax containing the carbonyl group are, polyalkanoic acid esters, polyalkanol esters, polyalkanoic amides, polyalkyl amides, dialkyl ketones, and the like. Examples of the polyalkanoic acid esters are carnauba wax, montan wax, trimethylolpropane tribehenate, pentaerythritol tetrabehenate, pentaerythritol diacetate dibehebate, glycerin tribehenate, 1,18-octadecandiol distearate, and the like. Examples of the polyalkanol ester are tristearyl trimellitate, distearyl maleate, and the like. Examples of the polyalkanoic amide are dibehenyl amide, and the like. Examples of the polyalkyl amides are trimellitic acid tristearyl amide, and the like. Examples of the dialkyl ketone are distearyl ketone, and the like. Among these waxes containing the carbonyl group, the polyalkanoic acid esters are particularly preferable.

Examples of the polyolefin wax are a polyethylene wax, a polypropylene wax, and the like.

Examples of the long-chain hydrocarbon wax are paraffin wax, sazol wax, and the like.

As a melting point (fusing point) of the releasing agent, there is no restriction in particular, and can be selected appropriately according to an object. However, it is preferable that the melting point of the releasing agent is 40° C. to 160° C. A range of 50° C. to 120° C. is more preferable, and a range of 60° C. to 90° C. is particularly preferable.

When the melting point is lower than 40° C., the wax may affect adversely the heat-resistant storage stability, and when the melting point is higher than 160° C., it is susceptible to an occurrence of a cold offset at the time of fixing at a low temperature.

As a melt viscosity of the releasing agent, a measured value at a temperature 20° C. higher than the melting point of the wax, in a range of 5 cps to 1,000 cps is preferable, and a measured value in a range of 10 cps to 100 cps is more preferable.

When the melt viscosity is less than 5 cps, the releasing property may be declined, and when the melt viscosity is more than 1000 cps, an effect of improvement in the hot-offset resistance and low-temperature fixing property may not be achieved.

A content of the releasing agent in the toner is not restricted in particular, and can be selected appropriately according to an object. However, it is preferable that the content of the releasing agent in the toner is 0 percent by mass to 40 percent by mass, and the content of the releasing agent in a range of 3 percent by mass to 30 percent by mass is more preferable. When the content is more than 40 percent by mass, the fluidity of the toner may be declined.

The charge controlling agent is not restricted in particular, and can be selected appropriately from the hitherto known charge controlling agents, according to an object. However, since there is a change in a color tone when a colored material is used, a material which is colorless or close to a white color is preferable. Examples charge controlling agent are triphenylmethane pigments, chelate molybdate pigments, rhodamine dyes, alkoxy amines, quaternary ammonium salts (including fluorine modified quaternary ammonium salts), alkyl amides, simple substances of phosphorus or compounds of the simple substance of phosphorus, simple substances of tungsten or compounds of the simple substance of tungsten, fluorine-based activators, metal salts of salicylic acid, metal salts of a derivative of salicylic acid, and the like. These may be used singly or may be used in combination of two or more of them . . . .

Charge controlling agents available commercially may be used. Examples of the charge controlling agent are BONTRON-51 as a quaternary ammonium salt, E-82 as an oxynaphtholic acid based metal complex, E-84 as a salicylic acid based metal complex), E-89 as a phenol based condensate (all manufactured by Orient Chemical Industries, Ltd.), TP-302 and TP-415 as quaternary ammonium salt molybdenum complexes (manufactured by Hodogaya Chemical Co., Ltd.), COPY CHARGE PSY VP2038 as a quaternary ammonium salt, COPY BLUE PR as a derivative of triphenyl methane, COPY CHARGE NEGVP2036 and COPY CHARGE NX VP434 as quaternary ammonium salts (all manufactured by Hoechst Co., Ltd.), LRA-901 and LR-147 as a boron complex (manufactured by Japan Carlit Co., Ltd.), quinacridone, azo pigments, and compounds having high molecules having other groups such as a sulfonic group, a carboxyl group, a functional group of having quaternary ammonium salt, and the like.

The charge controlling agent may be dissolved or dispersed after melting and kneading with the master batch, or may be added directly in the organic solvent at the time of dissolving or dispersing, along with each component of the toner, or may be fixed on a toner surface after preparing the toner particles.

A content of the charge controlling agent in the toner varies according to factors such as a type of the binder resin, presence or absence of an additive, and a dispersion method, and it cannot be stipulated categorically. However, for 100 parts by mass of the binder resin, the content in a range of 0.1 parts by mass to 10 parts by mass is preferable, and the content in a range of 0.2 parts by mass to 5 parts by mass is more preferable. When the content of the charge controlling agent is less than 0.1 parts by mass, the charge controlling property may not be achieved, and when the content of the charge controlling agent is more than 10 parts by mass, the charging ability of the toner is increased excessively, and this excessive increase in the charging ability attenuates an effect of a main charge controlling agent. Due to this, an electrostatic attraction with a developing roller is increased, and this may lead to a decline in fluidity of the developer and a decline in an image density.

—Fine Particles of Resin—

Fine particles of resin are not restricted in particular provided that the fine particles are of a resin which may form an aqueous dispersion in an aqueous medium, and can be selected appropriately from the hitherto known resins, according to an object. The resin may be a thermoplastic resin or a thermosetting (heat curing) resin. Examples of the resin are vinyl resins, polyurethane resins, epoxy resins, polyester resins, polyamide resins, polyimide resins, silicon resins, phenolic resins, melamine resins, urea resins, aniline resins, ionomer resins, polycarbonate resins, and the like. Among these, the vinyl resins are particularly preferable.

These may be used singly or may be used in combination of more than one. Among these resins, from a point of achieving easily the aqueous dispersion of resin particles having a fine (microscopic) spherical shape, it is preferable that the resin is formed by at least one of the types selected from the vinyl resins, the polyurethane resins, the epoxy resins, and the polyester resins.

The vinyl resins are polymers in which a vinyl monomer is homopolymerized or copolymerized. Examples of the vinyl resin are styrene-(meth)acrylic acid ester resins, styrene-butadiene copolymers, (meth)acrylic acid-acrylic acid ester polymers, styrene-acrylonitrile copolymers, styrene-anhydrous maleic acid copolymers, styrene-(meth)acrylic acid copolymers, and the like.

Moreover, copolymers which contain a monomer having at least two unsaturated groups can also be used as the fine particles of resin.

The monomer having at least two unsaturated groups is not restricted in particular, and can be selected appropriately according to an object. Examples of such monomer are sodium salts of ethylene oxide methacrylate adduct sulfuric ester ("ELEMINOL RS-30 manufactured by Sanyo Chemical Industries, Ltd.), divinyl benzene, 1,6-hexanediol acrylate, and the like.

The fine particles of resin can be achieved by polymerizing according to a hitherto known method selected appropriately according to an object. However, it is preferable to achieve the fine particles of resin as an aqueous dispersion of the fine particles of resin. Examples of methods for preparing the aqueous dispersion of the fine particles of resin are as follow.

(1) In a case of a vinyl resin, a method of manufacturing the aqueous dispersion of fine particles of resin directly, by any polymerization reaction selected from a suspension polymerization, an emulsion polymerization, a seed polymerization, and a dispersion polymerization, with a vinyl monomer as a starting material.

(2) In a case of polyaddition or condensation resins such as the polyester resins, the polyurethane resins, the epoxy resins, a method of manufacturing the aqueous dispersion of fine particles of resin by hardening by adding a hardening agent (curing agent) or by heating, after dispersing a precursor (monomer, oligomer, and the like.) or a solvent solution of the precursor in the presence of a suitable dispersing agent.

(3) In a case of polyaddition and condensations resins such as the polyester resins, the polyurethane resins, the epoxy resins, a method of phase-inversion emulsification by adding water after dissolving a suitable emulsifying agent in a precursor (monomer, oligomer, and the like.) or a solvent solution of that precursor (preferably a liquid. May be liquidized by heating).

(4) A method in which a resin prepared in advance by a polymerization reaction (may be any type of polymerization reaction such as an addition polymerization, a ring-opening polymerization, a polyaddition, an addition condensation, and a condensation polymerization) is pulverized by using a pulverizing mill or a jet type or a mechanical rotation type, and then after achieving the fine particles of resin by classifying, is dispersed in water in the presence of a suitable dispersing agent.

(5) A method in which a resin prepared in advance by a polymerization reaction (may be any type of polymerization reaction such as the addition polymerization, the ring-opening polymerization, the polyaddition, the addition condensation, and the condensation polymerization) is dissolved in a solvent, then after acquiring the fine particles of resin by spraying this resin solution in a spray form, the fine particles of resin are dispersed in water in the presence of a suitable dispersing agent.

(6) A method in which either a poor solvent is added to a resin solution in which a resin prepared in advance by a polymerization reaction (may be any type of polymerization reaction such as the addition polymerization, the ring-opening polymerization, the polyaddition, the addition condensation, and the condensation polymerization) is dissolved in a solvent, or the fine particles of resin are extracted (precipitated) by cooling a resin solution which is heated and dissolved in a solvent in advance, and then after acquiring the resin particles by removing the solvent, the resin particles are dispersed in water in the presence of a suitable dispersing agent.

(7) A method in which, after a resin solution in which a resin prepared in advance by a polymerization reaction (may be any type of polymerization reaction such as the addition polymerization, the ring-opening polymerization, the polyaddition, the addition condensation, and the condensation polymerization) is dissolved in a solvent, is dispersed in an aqueous medium in the presence of a suitable dispersing agent, the solvent is removed by heating or by decompression (by reducing pressure).

(8) A method in which, after dissolving a suitable emulsifying agent in a resin solution in which a resin prepared in advance by a polymerization reaction (may be any type of polymerization reaction such as the addition polymerization, the ring-opening polymerization, the polyaddition, the addition condensation, and the condensation polymerization) is dissolved in a solvent, the phase-inversion emulsification is carried out by adding water.

Examples of the toner are toners manufactured by hitherto known methods such as suspension polymerization, emulsification-coagulation method, and emulsification-dispersion method. However, a preferable example is of a toner which is achieved by the following method. A toner solution is prepared by dissolving in an organic solvent a toner material which includes an active hydrogen group-containing compound and a modified polyester resin which is a polymer capable of reacting with the active hydrogen group-containing compound. The toner solution is dispersed in an aqueous medium and a dispersion (dispersing liquid) is prepared. The active hydrogen group-containing compound and modified polyester resin which is capable of reacting with the active hydrogen group-containing compound are allowed to react in an aqueous medium and an adhesive base material is formed in the form of particles. The organic solvent is removed (from the adhesive base-material) and the toner is achieved.

—Toner Solution—

The toner solution is prepared by dissolving the toner material in an organic solvent.

—Organic Solvent—

The organic solvent is not restricted in particular provided that it is a solvent in which the toner material can be dissolved or dispersed, and can be selected appropriately according to an object. A volatile compound having a boiling point lower than 150° C. is preferable from a point of ease of removing. Examples of the organic solvent are toluene, xylene, benzene, carbon tetrachloride, methylene chloride, 1,2-dichloroethane, 1,1,2-trichloroethane, trichloroethylene, chloroform, monochlorobenzene, dichloroethylidine, methyl acetate, ethyl acetate, methyl ethyl ketone, methyl isobutyl ketone, and the like. Among these, toluene, xylene, benzene, methylene chloride, 1,2-dichloroethane, chloroform, and carbon tetrachloride are preferable, and ethyl acetate is particularly preferable. These may be used singly, or may be used in combination of two or more of them.

A quantity to be used of the organic solvent is not restricted in particular, and can be selected appropriately according to an object. It is preferable that the quantity is 40 parts by mass to 300 parts by mass for 100 parts by mass of the toner material. A range of 60 parts by mass to 140 parts by mass is more preferable, and a range of 80 parts by mass to 120 parts by mass is even more preferable.

—Dispersion—

The dispersion (dispersing liquid) is prepared by dispersing the toner solution in an aqueous medium. When the toner solution is dispersed in the aqueous medium, a dispersing element (oil droplets) made of the toner solution is formed in the aqueous medium.

—Aqueous Medium—

The aqueous medium is not restricted in particular, and can be selected appropriately from the hitherto known aqueous media. Examples of the aqueous medium are water, solvents which can be mixed with water, mixtures of water with such solvents, and the like. Among these, water is particularly preferable.

The solvent which can be mixed with water is not restricted in particular provided that the solvent can be mixed with water. Examples of such solvent are alcohols, dimethylformamides, tetrahydrofurans, cellosorbs, lower ketones, and the like.

Examples of alcohols are methanol, isopropanol, ethylene glycol, and the like. Examples of lower ketones are acetone, methyl ethyl ketone, and the like. These may be used singly or may be used in combination of two or more of them.

It is preferable that the toner solution is dispersed while stirring in the aqueous medium.

A method of dispersion is not restricted in particular, and can be selected appropriately from hitherto known methods such as by using a disperser. Examples of the disperser are a low-speed shearing disperser, a high-speed shearing disperser, a friction disperser, a high-pressure jet disperser, an ultrasonic disperser, and the like. Among these dispersers, the high-speed shearing disperser is preferable from a point that it is possible to control a particle diameter of the dispersing element (oil droplet) in a range of 2 μm to 20 μm.

When the high-speed shearing disperser is used, there is no restriction regarding conditions such as the number of rotations, a dispersion time, and a dispersion temperature, and these conditions can be selected appropriately according to an object. However, it is preferable that the number of rotations are is a range of 1000 rpm to 30000 rpm, and a range of 5000 rpm to 20000 rpm is more preferable. Regarding the dispersion time, in a case of a batch method, it is preferable that the dispersion time is 0.1 minute to 5 minutes. It is preferable that the dispersion temperature is 0° C. to 150° C. under pressurized condition, and a range of 40° C. to 98° C. is more preferable. Generally, the dispersion is easy when the dispersion temperature is high.

As an example of a method of manufacturing the toner, a method of achieving toner by forming the adhesive base-material in the form of particles is described below.

In the method of manufacturing the toner by forming the adhesive base-material in the form of particles, processes are carried out such as a preparation of an aqueous medium phase, a preparation of the toner solution, a preparation of the dispersion (dispersing liquid), an addition of the aqueous medium, and other processes (such as a preparation of the modified polyester resin (prepolymer) which is capable of reacting with the active hydrogen group-containing compound, and a preparation of the active hydrogen group-containing compound).

The aqueous medium phase can be prepared for example, by dispersing the fine particles of resin in the aqueous medium. An amount of the fine particles of resin to be added to the aqueous medium is not restricted in particular, and can be selected appropriately according to an object. It is preferable that the amount of the fine particles of resin to be added to the aqueous medium is 0.5 percent by mass to 10 percent by mass.

The toner can be prepared by dissolving or dispersing in the organic solvent, toner materials such as the active hydrogen group-containing compound, the modified polyester resin which is a polymer capable of reacting with the active hydrogen group-containing compound, the colorant, the releasing agent, the charge controlling agent, and a polyester component soluble in ethyl acetate.

In the toner material, in the preparation of the aqueous medium phase, the component other than the modified polyester resin (prepolymer) which is a polymer capable of reacting with the active hydrogen group-containing compound, may be added to and mixed with the aqueous medium at the time of dispersing the fine particles of resin in the aqueous medium, or may be added to the aqueous medium phase together with the toner solution, at the time of adding the toner solution to the aqueous medium phase.

The dispersion (dispersing liquid) can be prepared by emulsifying and/or dispersing the toner solution prepared earlier in the aqueous medium phase prepared earlier. Moreover, at the time of emulsification or dispersion, when the active hydrogen group-containing compound and the modified polyester resin which is a polymer capable of reacting with the active hydrogen group-containing compound are subjected to the extension reaction and the cross-linking reaction, the adhesive base-material is formed.

The adhesive base-material (such as the urea modified polyester resin) may be formed for example (1) by forming a dispersing element by dispersing or emulsifying in the aqueous medium phase the toner solution containing (1) the modified polyester resin (such as the polyester prepolymer (A) containing the isocyanate group) which is a polymer capable of reacting with the active hydrogen group-containing compound, along with the active hydrogen group-containing compound (such as the amine (B)), and by allowing the modified polyester resin and the active hydrogen group-containing compound to undergo the extension reaction or the cross-linking reaction in the aqueous medium phase, or (2) by forming a dispersing element by emulsifying or dispersing the toner solution in the aqueous medium to which, the active hydrogen group-containing compound is added in advance, and by allowing the two to undergo the extension reaction or the cross-linking reaction in the aqueous medium phase, or (3) by forming a dispersing element by adding the active hydrogen group-containing compound after the toner solution is added to and mixed with the aqueous medium, and allowing the two to undergo the extension reaction or the cross-linking reaction from particle interface in the aqueous medium phase. In a case of (3) mentioned above, it is possible to let the modified polyester resin be formed preferentially on a surface of the toner formed, and to provide a concentration gradient in the toner particles.

A condition for reaction for forming the adhesive base material by the emulsion or the dispersion is not restricted in particular, and can be selected appropriately according to a combination of the modified polyester resin which a polymer capable of reacting with the active hydrogen group-containing compound, and the active hydrogen group-containing compound. It is preferable that a reaction time is 10 minutes to 40 hours, and the reaction time in a range of 2 hours to 24 hours is more preferable. It is preferable that a reaction temperature is 0° C. to 150° C., and the reaction temperature in a range of 40° C. to 98° C. is more preferable.

An example of a method for forming stably the dispersing element containing the modified polyester resin (such as the polyester prepolymer (A) containing the isocyanate group) which is a polymer capable of reacting with the active hydrogen group-containing compound, is a method in which the toner solution prepared by dissolving or dispersing in the organic solvent, the toner materials such as the modified polyester resin (such as the polyester prepolymer (A) containing the isocyanate group) which is a polymer capable of reacting with the active hydrogen group-containing compound), the colorant, the releasing agent, the charge controlling agent, and a binder resin which differs from the polymer having a site which is capable of reacting with the active hydrogen group-containing compound are added to the aqueous medium phase, and dispersed by a shearing force. Details of the method of dispersion are as described above.

In the preparation of the dispersion (dispersing liquid), it is preferable to use a dispersing agent according to the requirement, from a point of view of stabilizing the dispersing element (oil droplets made of toner solution), and making the particle distribution sharp while achieving the desired shape.

The dispersing agent is not restricted in particular, and can be selected appropriately according to an object. Examples of the dispersing agent are surfactants, water-insoluble inorganic compound dispersing agents, high-molecular protective colloids, and the like. These may be used singly or may be used together in combination of more than one. Among these dispersing agents, the surfactants are preferable.

Examples of the surfactant are anionic surfactants, cationic surfactants, non-ionic surfactants, ampholytic surfactants, and the like.

Examples of the anionic surfactants are alkyl benzene sulfonate, α-olefin sulfonate, ester phosphate, and the like, and a preferable example is an anionic surfactant having a fluoroalkyl group. Examples of anionic surfactant having the fluoroalkyl group are fluoroalkyl carboxylic acid or metal salts of fluoroalkyl carboxylic acid, having a carbon number from 2 to 20, disodium perfluorooctane sulfonyl glutamate, sodium 3-[Ω-fluoroalkyl(C(carbon number)6 to C11)oxy]-1-alkyl (C3 to C4) sulfonate, sodium 3-[Ω-fluoroalkanoyl(C6 to C8)-N-ethylamino]-1-propane sulfonate, fluoroalkyl (C11 to C20) carboxylic acid and metal salts thereof, perfluoroalkyl carboxylic acid (C7 to C13) and metal salts thereof, perfluoroalkyl (C14 to C12) sulfonic acid and metal salts thereof, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salts, perfluoroalkyl (C6 to C10)-N-ethylsulfonyl glycine salts, ester mono-perfluoroalkyl (C6 to C16) ethyl phosphate, and the like. Examples of commercial products of the surfactant having the fluoroalkyl group are SURFLON S111, S112, and S113 (manufactured by ASAHI GLASS CO., LTD.), FLUORAD FC-93, FC-95, FC-98, and FC-129 (manufactured by Sumitomo 3M Co., Ltd.), UNIDINE DS-101, DS-102 (manufactured by Daikin Industries, Ltd.), MEGAFACE F-110, F-120, F-113, F-191, F-812, and F-833 (manufactured by Dai Nippon Ink & Chemicals, Inc.), EKTOP EF-102, 103, 104, 105, 112, 123A, 123B, 306A, 501, 201, and 204 (manufactured by Tochem Products Co., Ltd.), and FTERGENT F-100 and F150 (manufactured by NEOS Co., Ltd.).

Examples of cationic surfactants are amine-salt surfactants and cationic surfactants of quaternary ammonium salt. Examples of the amine-salt surfactants are alkyl amine salts, aminoalcohol fatty acid derivatives, polyamine fatty acid derivatives, imidazoline, and the like. Examples of the cationic surfactants of the quaternary ammonium salts are alkyl trimethyl ammonium salts, dialkyl dimethyl ammonium salts, alkyl dimethyl benzyl ammonium salts, pyridinium salts, alkyl isoquinolinium salts, benzethonium chloride, and the like. Among the cationic surfactants, the examples are primary aliphatic amino acids, secondary aliphatic amino acids, and tertiary aliphatic amino acids having a fluoroalkyl group, quaternary aliphatic ammonium salts such as perfluoroalkyl (C6 to C10) sulfonamide propyltrimethyl ammonium salt, and the like, benzalkonium salts, benzethonium chloride, pyridinium salts, imidazolinium salts, and the like. The examples of commercial products available are SURFLON S-121 (manufactured by ASAHI GLASS CO., LTD.), FLUORAD FC-135 (manufactured by Sumitomo 3M Co., Ltd.), UNIDINE DS-202 (manufactured by Daikin Industries, Ltd.), MEGAFACE F150 and F-824 (manufactured by Dai Nippon Ink & Chemicals, Inc.), EKTOP EF-132 (manufactured by Tochem Products Co., Ltd.), and FTERGENT F-300 (manufactured by NEOS Co., Ltd.).

Examples of non-ionic surfactants are fatty acid amide derivatives, polyhydric alcohol derivatives, and the like.

Examples of the ampholytic surfactants are alanine, dodecyl di(aminoethyl)glycine, di(octylaminoethyl)glycine, N-alkyl-N,N-dimethyl ammonium betaine, and the like.

Examples of water-insoluble inorganic dispersing agents are calcium phosphate-tribasic, calcium carbonate, titanium oxide, colloidal silica, hydroxyapatite, and the like.

Examples of the high-molecular protective collides are acids, (meth)acrylic monomers containing a hydroxyl group, vinyl alcohols or ethers of vinyl alcohols, esters of compounds which contain a vinyl alcohol or a carboxyl group, amide compounds or methylol compounds of the amide compounds, chlorides, homopolymers or copolymers of compounds having a nitrogen atom or heterocycles of the nitrogen atom, polyoxyethylenes, celluloses, and the like.

Examples of acids are acrylic acid, methacrylic acid, α-cyanoacrylic acid, α-cyanomethacrylic acid, itaconic acid, crotonic acid, fumaric acid, maleic acid, and anhydrous maleic acid. Examples of (meth)acrylic monomers which contain the hydroxyl croup are β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethylene glycol monoacrylic ester, diethylene glycol monomethacrylic ester, glycerin monoacrylic ester, glycerin monomethacrylic ester, N-methylol acrylamide, N-methylol methacrylamide, and the like. Examples of the vinyl alcohols or ethers with the vinyl alcohol are vinyl methyl ether, vinyl ethyl ether, vinyl propyl ether, and the like. Examples of esters of compounds which contain a vinyl alcohol and a carboxyl group are vinyl acetate, vinyl propionate, vinyl butyrate, and the like. Examples of the amides or the methylol compounds of the amides are acrylamides, methacrylamides, diacetoneacrylamides or methylol compounds of diacetoneacrylamides, and the like. Examples of chlorides are acrylic acid chlorides, methacrylic acid chlorides, and the like. Examples of the homopolymers or copolymers of compounds having a nitrogen atoms or heterocycles of the nitrogen atom are vinyl pyridine, vinyl pyrrolidine, vinyl imidazole, ethyleneimine and the like. Examples of the polyoxyethylenes are polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester, polyoxyethylene nonylphenyl ester, and the like. Examples of the celluloses are methyl cellulose, hydroxyethyl cellulose, hydroxypropyl cellulose, and the like.

In the preparation of the dispersion (dispersing liquid), a dispersion stabilizer can be used according to the requirement.

Examples of the dispersion stabilizer are acids such as of a calcium phosphate salt, and the like, compounds soluble in an alkali, and the like.

When the dispersion stabilizer is used, after the calcium phosphate salt is dissolved in an acid such as hydrochloric acid, the calcium phosphate salt can be removed from the fine particles by a method of cleaning or a method of decomposing by an enzyme.

In the preparation of the dispersion (dispersing liquid), a catalyst of the extension reaction or the cross-linking reaction can be used. Examples of the catalyst are dibutyl tin laurate, dioctyl tin laurate, and the like.

An organic solvent is removed from the dispersion (emulsion slurry). Examples of a method for removing the organic solvent are methods such as (1) a method in which, the whole system is heated up gradually, and the organic solvent in the oil droplets is removed completely by evaporation, and (2) a method in which the toner fine particles are formed by atomizing (spraying) an emulsified dispersing element in a dry atmosphere, and then removing completely the water-insoluble organic solvent in the oil droplets, and along with this an aqueous dispersing agent is removed completely by evaporation.

As the organic solvent is removed, the toner particles are formed. These toner particles can be cleaned and dried, and further be classified as desired. The toner particles can be classified by eliminating the particulate portion by a cyclone, a decanter, and a centrifugal separation, in the liquid. Classification operation may be carried out after acquiring fine particles upon drying.

By mixing the toner particles obtained in such manner, with particles of the charge controlling agent, the releasing agent, and the colorant, and by further applying a mechanical impact thereon, it is possible to prevent the particles of the releasing agent etc. from being detached from a surface of the toner particles.

The method for applying the mechanical impact is not restricted in particular, and examples are, a method in which an impact force is applied to a mixture by a blade rotating at a high speed, and a method in which, the mixture is placed in a high-speed air flow and accelerated such that particles or composite particles are allowed to collide on a collision plate. Examples of devices using these methods are ONG MILL (manufactured by Hosokawa Micron Co., Ltd.), a device in which pulverizing-air pressure is reduced by modifying I-MILL (manufactured by Nippon Pneumatic Mfg. Co., Ltd.), HYBRIDIZATION SYSTEM (manufactured by NARA MACHINERY CO., LTD.), CRYPTRON SYSTEM (manufactured by Kawasaki Heavy Industries, Ltd., AUTO MORTAR, and the like.

It is preferable that the toner has the following weight-average particle diameter, weight-average particle diameter/number-average particle diameter (Dn), and the glass transition temperature (Tg).

It is preferable that the weight-average particle diameter of the toner is 3 μm to 8 μm. The weight-average particle diameter in a range of 4 μm to 7 μm is more preferable, and a range of 5 μm to 6 μm is even more preferable. Here, the weight-average particle diameter is defined as $$\text{weight-average particle diameter}=[(\Sigma(nD^3)/\Sigma n)]^{1/3}$$

where, in this expression, n is the number of particles and D is a particle diameter.

When the weight-average particle diameter is less than 3 μm, for a (with a) two-component developer, the toner is fused on a surface of a carrier when stirred for a long time in a developing unit, and declines a charging capability of the carrier. Moreover, for a (with a) one-component developer, since there is a filming of the toner on a developing roller and a thin layer of toner is formed, the toner is susceptible to be fused on a member such as a blade. When the weight-average particle size is more than 8 μm, it becomes difficult to achieve a high quality image with high resolution, and when the toner in the developer is added or removed, there may be a large variation in the particle diameter of the toner.

It is preferable that a ratio (Dw/Dn) of the weight-average particle diameter (Dw) and the number-average particle diameter (Dn) is 1.25 or less, and a ration in a range of 1.05 to 1.25 is more preferable.

Generally, it is said that smaller the particle diameter of the toner, it is advantageous for achieving a high quality image with high resolution, but it is disadvantageous for a transfer property and a cleaning ability. Moreover, when the volume-average particle diameter is smaller than a range according to the present invention, for a two-component developer, the toner is fused on the surface of the carrier in stirring for long time in the developing unit, and leads to a decline in the charging capability of the carrier. In a case when the one-component developer is used, since there is a filming of the toner on the developing roller and a thin layer of toner is formed, the toner is susceptible to be fused on a member such as the blade. Moreover, these developing are similar even for a toner having a content of the fine particles more than the range according to the present invention. Whereas, when the particle diameter of the toner is greater than the range according to the present invention, it becomes difficult to achieve a high quality image with high resolution, and also, when the toner in the developer is added or removed, in many cases there may be a large variation in the particle diameter of the toner. Moreover, it became evident that it is similar when the (ratio of the) weight-average particle diameter/number-average particle diameter is more than 1.25.

On the other hand, when the (ratio of the) weight-average particle diameter/number-average particle diameter is less than 1.05, it is favorable from an aspect of stabilization of toner behavior, and making uniform an amount of charging. However, cases in which the charging of the toner is insufficient have been observed, and moreover, it became evident that the cleaning ability may be declined.

The weight-average particle diameter (Dw) and the number-average particle diameter (Dn) of the toner were measured by using a particle-size measuring instrument (grind gauge) ("MULTISIZER III, manufactured by Beckman-Coulter Inc.), with an aperture diameter of 100 μm, and analysis was carried out by an analysis software (Beckman Coulter Multisizer 3, Version 3.51). Concretely, 0.5 ml of a surfactant having 10 percent by mass (alkylbenzene sulfonate, NeoGen SC-A manufactured by DAI-ICHI KOGYO SEIYAKU CO., LTD.) was added to a 100 ml glass beaker, then 0.5 g of each toner was added, and the mixture was stirred with a micro spatula. Further, 80 ml of ion-exchange water was added. A dispersion (dispersing liquid) obtained was subjected to a dispersion treatment for 10 minutes in an ultrasonic disperser (W-113MK-II, manufactured by HONDA ELECTRONIC CO., LTD.). The dispersion was measured by using the MULTISIZER-III, by using ISOTONE III (manufactured by Beckman-Coulter Inc.). For the measurement, the toner sample dispersion was dripped such that a concentration indicated by the device was 8±2%. In this measurement method, from a point of reproducibility of measurement of the particle diameter, it is important that the concentration is let to be 8±2%. In this concentration range, no error occurs in the particle diameter.

It is preferable that the glass transition temperature of the toner is 40° C. to 70° C. When the glass transition temperature is lower than 40° C., the heat-resistant storage stability may be insufficient, and when the glass transition temperature is higher than 70° C., the low-temperature fixing property may be affected adversely.

Here, the glass transition temperature (Tg) is concretely determined by the following procedure. TA-60WS and DSC-60 manufactured by Shimadzu Seisakusho Co., Ltd. were used as measuring instruments, and the measurement was carried out with the measurement conditions shown below.

[Measurement Conditions]

Sample container: A sample pan (having a lid) made of aluminum

Sample amount: 5 mg

Reference: Sample pan made of aluminum (alumina 10 mg)

Atmosphere: Nitrogen (flow rate 50 ml/min)

Temperature conditions

Start temperature: 20° C.

Programming rate: 10° C./min

End temperature: 150° C.

Hold time: Nil

Cooling rate: 10° C./min

End temperature: 20° C.

Hold time: Nil

Programming rate: 10° C./min

End temperature: 150° C.

A result of the measurement was analyzed by using data analysis software (TA-60, Version 1.52) manufactured by Shimadzu Seisakusho Co., Ltd. As a method for analyzing, a range of ±50° C. is specified with a point showing a maximum peak on the lowest temperature side of a DrDSC curve which is a DSC differential curve of a temperature rise for a second time, and a peak temperature is determined (calculated) by using a peak analysis function of the analysis software. Next, a maximum endothermic temperature of the DSC curve is determined by using the peak analysis function of the analysis software in a range of the peak temperature +5° C. and the peak temperature −5° C. with the DSC curve. The temperature shown here is equivalent to the glass transition temperature (Tg).

A color of the toner is not restricted in particular, and can be selected appropriately according to an object. It is possible to let the color of the toner to be of at least one type selected from a black toner, a cyan toner, a magenta toner, and a yellow toner. The toner of each color can be obtained by selecting appropriately the type of the colorant, and it is preferable that the toner is a color toner.

(Developer)

A developer according to the present invention contains at least the toner according to the present invention, and contains other components (constituents) selected appropriately, such as the carrier. The developer may be a one-component developer or a two-component developer, and in a case of using a high-speed printer which deals with an improvement in an information-processing speed in recent years, the two-component developer is preferable from a point of improvement in a life span.

In a case of the one-component developer in which the toner according to the present invention is used, even when the toner in the developer is added or removed, the variation in the particle diameter of the toner is small, and there is no filming of the toner on the developing roller and the thin layer of the toner is not formed. Therefore, the toner is not fused on the member such as the blade, and even when the developing unit is used (stirring) for a long period of time, a favorable and stable developing property and image are achieved. Moreover, in a case of the two-component developer in which the toner according to the present invention is used, even when the toner in the developer is added or removed for a long period of time, the variation in the particle diameter of the toner is small, and even when the stirring is carried out for a long time in the developing unit, the favorable and stabilized developing property is achieved.

The carrier is not restricted in particular, and can be selected appropriately according to an object. It is preferable that the carrier has a core material, and a resin layer covering the core material.

The core material is not restricted in particular, and can be selected appropriately from the hitherto known core materials. A material such as a manganese-magnesium (Mn—Mg) based material and a manganese-strontium (Mn—Sr) based material in a range of 50 emu/g to 90 emu/g is preferable as the core material, and from a point of ensuring the image density, a highly magnetized material such as iron powder (100 emu/g or more) and magnetite (75 emu/g to 120 emu/g). Moreover, a weakly magnetized material such as a copper-zinc (Cu—Zn) based material (30 emu/g to 80 emu/g) is preferable since the weakly magnetized material is capable of weakening a contact with a photoconductor on which the toner is erected (forming a brush) and advantageous in having a high image quality. These may be used singly, or may be used in combination of more than one.

As a particle diameter of the core material, it is preferable that an average particle diameter (weight-average particle diameter ($D_{50}$)) is 10 μm to 200 μm, and the average particle diameter in a range of 40 μm to 100 μm is more preferable.

When the average particle diameter (weight-average particle diameter ($D_{50}$)) is less than 10 μm, in a distribution of carrier particles, fine particles are increased and a magnetization per particle becomes low, thereby causing a scattering of the carrier. When the average particle diameter (weight-average particle diameter ($D_{50}$)) is more than 200 μm, a specific surface area is decreased, and the toner scattering may occur. In a full color having a substantial beta portion, reproducing of the beta portion in particular may be declined.

A material of the resin layer is not restricted in particular, and can be selected appropriately according to an object, from among hitherto known resins. Examples of the material of the resin layer are amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene with vinylidene fluoride with non-fluoride monomer, silicon resins, and the like. These may be used singly or may be used in combination of two or more.

Examples of the amino resins are urea-formaldehyde resins, melamine resins, benzoguanamine resins, urea resins, polyamide resins, epoxy resins, and the like. Examples of the polyvinyl resins are acrylic resins, polymethyl methacrylate resins, polyacrylonitrile resins, polyvinyl acetate resins, polyvinyl alcohol resins, polyvinyl butyral resins, and the like. Examples of the polystyrene resins are polystyrene resins, styrene-acryl copolymer resins, and the like. Examples of the halogenated olefin resins are polyvinyl chloride, and the like. Examples of the polyester resins are polyethylene terephthalate resins, polybutylene terephthalate resins, and the like.

Electroconductive powder may be included in the resin layer according to the requirement. Examples of the electroconductive powder are a metal powder, carbon black, titanium oxide, tin oxide, zinc oxide, and the like. It is preferable that an average particle diameter of these electroconductive powders is 1 μm or less. When the average particle diameter is more than 1 μm, a control of an electric resistance may become difficult.

The resin layer can be formed by a method in which, after preparing an applying solution (solution for applying) by dissolving a resin such as a silicon resin in a solvent, the applying solution is applied uniformly on a surface of the core material, by a hitherto known application method. Examples of the application method are a dip method (soaking method), a spraying method, a brush painting method, and the like.

The solvent is not restricted in particular, and can be selected appropriately according to an object. Examples of the solvent are toluene, xylene, methyl ethyl ketone, methyl isobutyl ketone, cellosorb, butyl acetate, and the like.

The baking (method) is not restricted in particular, and may be by an external heating or may be by an internal heating. Examples of a method for baking are methods using a fixed electric furnace, a fluid electric furnace, a rotary electric furnace, a burner furnace, methods using microwaves, and the like.

It is preferable that an amount of the resin in the carrier is 0.01 percent by mass to 5.0 percent by mass. When the amount of the resin is less than 0.01 percent by mass, the resin layer may not be formed uniformly on the surface of the core material, and when the amount of the resin is more than 5.0 percent by mass, the resin layer becomes excessively thick, and there is a granulation of the carriers, and uniform carrier particles may not be formed.

When the developer is a two-component developer, the carrier content in the two-component developer is not limited in particular, and can be selected appropriately according to an object. It is preferable that the carrier content in the two-component developer is 90 percent by mass to 98 percent by mass, and a range of 93 percent by mass to 97 percent by mass is more preferable.

A mixing ratio of the carrier and the toner of the two-component developer is generally 1 part by mass to 10.0 parts by mass of the toner, for 100 parts by mass of the carrier.

Since the developer according to the present invention contains the toner according to the present invention, it is possible to have both of an excellent low-temperature fixing quality and the offset resistance, and it is possible to form a favorable highly defined image.

The developer according to the present invention can be used preferably in image formation by each type of hitherto known electrophotography method such as a magnetic one-component developing method, a non-magnetic one-component developing method, and a two-component developing method, and it is possible to use preferably, particularly in a toner container, a process cartridge, an image forming apparatus, and an image forming method.

(Toner Container)

The toner container according to the present invention is a receptacle which accommodates the toner or the developer according to the present invention.

The toner container is not restricted in particular, and can be selected appropriately from the hitherto known toner containers. Preferable examples of the toner container are a receptacle having a toner container main body and a cap, and the like.

The toner container main body is not restricted in particular in terms of a size, a shape, a structure, and a material, and can be selected appropriately according to an object. It is preferable that the toner container main body has a circular cylindrical shape for example. Regarding the structure of the toner container, it is particularly preferable that recesses and projections in a spiral form are formed on an inner circumferential surface, the toner which is the content of the toner container main body is movable toward a discharge port by allowing the toner container main body to rotate, and a part of or an entire spiral portion has a folding function.

The material of the toner container main body is not restricted in particular, and can be selected appropriately according to an object. A material having a favorable dimensional accuracy is preferable, and a preferable example of the material is a resin. Among the resins, examples of preferable resins are the polyester resins, the polyethylene resins, the polypropylene resins, the polystyrene resins, the polyvinyl chloride resins, the polyacrylic resins, the polycarbonate resins, ABS resins, polyacetal resins, and the like.

The toner container according to the present invention is easily preservable and easily transportable, and has an excellent handling property. Therefore, the toner container according to the present invention can be used preferably for replenishing the toner by detachably installing to the process cartridge and the image forming apparatus according to the present invention which will be described later.

(Process Cartridge)

The process cartridge according to the present invention includes at least a latent electrostatic image bearing member which bears a latent electrostatic image, a developing unit configured to develop the latent electrostatic image on the latent electrostatic image bearing member by using the toner to form a visible image, and further includes other units selected appropriately according to the requirement.

The developing unit includes at least a developer receptacle which accommodates the toner or the developer according to the present invention, and a developer bearing member which bears and transports the toner and the developer accommodated in the developer receptacle, and further includes a layer-thickness regulating member which regulates a thickness of a toner layer which is to be borne.

It is preferable that the process cartridge according to the present invention can be detachably provided to each electrophotography unit, and is detachably provided to the electrophotography unit according to the present invention.

Here, the process cartridge, as shown in FIG. 1, is a unit (component) which includes a photoconductor 101 which is built-in, and at least one of a charging unit 102, a developing unit 104, a transferring unit 108, a cleaning unit 107, and a decharging unit (not shown in the diagram) apart from the photoconductor 101, and which is detachable from an image forming apparatus main body.

Here, regarding an image forming process by the process cartridge shown in FIG. 1, while the photoconductor 101 rotates in a direction of an arrow, due to charging by the charging unit 102, and exposing 103 by an exposing unit (not shown in the diagram), a latent electrostatic image corresponding to an exposed image is formed on a surface thereof. This latent electrostatic image is developed by the toner in the developing unit. The toner-developed image is transferred to a recording medium 105 by the transferring unit 108, and then printed out. Next, a surface of the photoconductor 101 after transferring the image is cleaned by the cleaning unit 107, and further decharged by the decharging unit (not shown in the diagram), and the abovementioned operation is repeated once again.

(Image Forming Apparatus and Image Forming Method)

The image forming apparatus according to the present invention includes at least a latent electrostatic image bearing member, a latent electrostatic image forming unit, a developing unit, a transferring unit, and a fixing unit, and further includes other units which can be selected appropriately according to the requirement, such as a decharging unit, a cleaning unit, a recycling unit, and a controlling unit.

The image forming method according to the present invention includes at least latent electrostatic image forming, developing, transferring, and fixing, and further includes other processes which can be selected appropriately according to the requirement, such as decharging, cleaning, recycling, and controlling.

The image forming method according to the present invention can be preferably executed by the image forming apparatus according to the present invention. The latent electrostatic image forming can be carried out by the latent electrostatic image forming unit, the developing can be carried out by the developing unit, the transferring can be carried out by the transferring unit, the fixing can be carried out by the fixing unit, and the other processes can be carried out by the other units.

—Latent Electrostatic Image Forming and Latent Electrostatic Image Forming Unit—

The latent electrostatic image forming includes forming a latent electrostatic image on the latent electrostatic image bearing member.

The latent electrostatic image bearing member (may be referred to as a "photoconductive insulating member", a "photoconductor for electrophotography", and a "photoconductor") is not restricted in particular in terms of a size, a shape, a structure, and a material, and can be selected appropriately from among the hitherto known latent electrostatic image bearing members. It is preferable that the latent electrostatic photoconductor has a drum shape, and examples of a preferable material are, an inorganic photoconductor made of a material such as amorphous silicon, selenium, and the like, an organic photoconductor made of a material such as polysilane, phthalopolymethine, and the like. From a point of a long life, amorphous silicon is preferable among these materials.

As the amorphous silicon photoconductor, a photoconductor in which, a substrate is heated to a temperature of 50° C. to 400° C., and in which, a photoconductive layer made of a-Si is formed by a method of film forming such as a vacuum vapor deposition method, a sputtering method, an ion plating method, a thermal chemical vapor deposition method, an optical chemical vapor deposition method, and a plasma chemical vapor deposition method (hereinafter, may be referred to as "a-Si photoconductor") can be used. Among these methods, the plasma CVD method, in other words, a method of forming an a-Si deposition film on a substrate by decomposing a raw material gas by a direct current, or a high frequency waves or a microwave glow discharge is preferable.

The latent electrostatic image can be formed by charging uniformly a surface of the latent electrostatic image bearing member, and then by exposing image-wise (by image-wise exposure) by the latent electrostatic image forming unit.

The latent electrostatic image forming unit includes at least a charger which charges uniformly the surface of the latent electrostatic image bearing member, and an exposing unit which exposes image-wise the surface of the latent electrostatic image bearing member.

The charging can be carried out by applying a voltage to the surface of the latent electrostatic image bearing member by the charger.

The charger is not restricted in particular, and can be selected appropriately according to an object. Examples of the charger are hitherto known contact chargers which include an electroconductive or a semielectroconductive roller, a brush, a film, and a rubber blade, and non-contact charger in which a corona discharge such as a cortoron discharge and a scortoron discharge is used.

The charging member in any form such as a magnetic brush and a fur brush, apart from a roller may be used, and can be selected according to specifications and form of the electrophotographic apparatus. In a case of using the magnetic brush, a magnetic brush is formed such that various types of ferrite particles such as Zn—Cu ferrite are used as the charging member, and includes a nonmagnetic electroconductive sleeve for supporting the charging member, and a magnet roll which is accommodated in the nonmagnetic electroconductive sleeve. Moreover, in a case of using a (fur) brush, fur which is subjected to an electroconductivity treatment by carbon, copper sulfide, and a metal or a metallic oxide is to be used, and is let to be the charger by winding or sticking this fur around a metal or a core metal which is subjected to the electroconductivity treatment.

The charger is not restricted in particular to the contact charger, and it is preferable to use the contact charger as it is possible to have an image forming apparatus in which, ozone generated from the charger is reduced.

The exposing can be carried out by exposing image-wise the surface of the latent electrostatic image bearing member by using the exposing unit.

The exposing unit is not restricted in particular provided that the exposing unit is capable of exposing image-wise, on the surface of the latent electrostatic image bearing member which is charged by the charger, and can be selected appropriately according to an object. Examples of the exposing unit are various exposing units of a copying optical system, a rod-lens array system, a laser optical system, a liquid-crystal shutter optical system, and the like.

In the present invention, an optical back-exposure may be adopted, in which the image-wise exposure is carried out from a rear surface side of the latent electrostatic image bearing member.

—Developing and Developing Unit—

The developing includes developing the latent electrostatic image by using the toner or the developer according to the present invention, and forming a visible image.

The visible image can be formed for example, by developing the latent electrostatic image by the toner or the developer according to the present invention, by the developing unit.

The developing unit is not restricted in particular provided that the developing unit is capable of developing by using the toner or the developer according to the present invention, and can be selected appropriately from the hitherto known developers. For example, a preferable example of the developing unit is a developing unit which includes at least a developer unit which accommodates the toner or the developer according to the present invention, and which is capable of applying the toner or the developer to the latent electrostatic image by making a contact or without making a contact, and a developer unit which includes the toner container is more preferable.

The developer unit may be a developer unit for a dry developing or a developer unit for a wet developing, and moreover, may be a developer unit for a monochrome or a developer unit for a multicolor (polychrome). A preferable example of the developer unit is a developer unit which includes a stirrer which charges the toner or the developer by friction stirring, and a magnet roller which is rotatable.

In the developer unit, for example, the toner and the carrier are mixed and stirred, and the toner is charged by a friction at the time of stirring, and held in an erected form on a surface of the rotating magnet roller, thereby forming a magnetic brush. Since the magnet roller is disposed near the latent electrostatic image bearing member (photoconductor), a part of the toner forming the magnetic brush formed on the surface of the magnet roller moves to (is shifted to) the surface of the latent electrostatic image bearing member (photoconductor) due to an electrical force of attraction. As a result of this, the latent electrostatic image is developed by the toner, and a visible image by the toner is formed on the surface of the latent electrostatic image bearing member (photoconductor).

The developer accommodated in the developer unit is a developer which includes the toner according to the present invention, and the developer may be a one-component developer or may be a two-component developer. The toner included in the developer is the toner according to the present invention.

—Transferring and Transferring Unit—

The transferring includes transferring the visible image onto a recording medium, and a mode in which, the visible image is subjected to a secondary transferring and transferred to the recording medium after the visible image is subjected to a primary transferring to an intermediate transferring member by using the intermediate transferring member, is preferable. A mode in which, more than one color of the toner, preferably full-color toner is used, and which includes a primary transferring in which a combined transferred image is formed by transferring the visible image to the intermediate transferring member, and a secondary transferring in which the combined transferred image is transferred on (to) the recording medium.

The transferring can be carried out for example, by charging the latent electrostatic image bearing member (photoconductor) by using the charger (and transferring the visible image), by the transferring unit. As the transferring unit, a preferable mode is a mode having a primary transferring unit which forms the combined transferred image by transferring to the visible image on to the intermediate transferring member, and a secondary transferring unit which transfers the combined transferred image to the recording medium.

The intermediate transferring member is not restricted in particular, and can be selected appropriately from among hitherto known transferring members, according to an object. A preferable example of the intermediate transferring member is a transfer belt.

It is preferable that a coefficient of static friction of the intermediate transferring body is 0.1 to 0.6, and the coefficient of static friction in the range of 0.3 to 0.5 is more preferable. It is preferable that a volume resistance of the intermediate transferring member is few Ωcm to $10^3$ Ωcm. By letting the volume resistance to be in the range of few Ωcm to $10^3$ Ωcm, since it is possible to prevent the charging of the intermediate charging member, and an electric charge applied by an electric charge applying unit is hard to remain on the intermediate transferring member, it is possible to prevent an unevenness in transferring at the time of the secondary transferring. Moreover, it is possible to apply a transfer bias at the time of the secondary transferring.

A material of the intermediate transferring medium is not restricted in particular, and can be selected appropriately according to an object, from among the hitherto known materials. For example, (1) examples are materials in which a material having a high Young's modulus (modulus of elongation) is used as a single layer belt, blend materials of PC (polycarbonate), PVDF (polyvinylidene fluoride), PAT (polyalkylene terephthalate), PC (polycarbonate)/PAT (polyalkylene terephthalate), a blend materials of ETFE (ethylene-tetra-fluoroethylene copolymer)/PC, ETFE/PAT, and PC/PAT, a carbon black dispersed thermosetting polyimide (thermosetting polyimide with carbon black dispersed therein), and the like. These single layer belts having the high Young's modulus have a merit of having a small amount of deformation for a stress at the time of image forming, and a register is hard to occur particularly at the time of color image forming. (2) The belt is a two to three layered structure with the belt having the high Young's modulus as a base layer, and a surface layer or an intermediate layer applied on a circumference thereof, and this two to three layered belt has a function which is capable of preventing a hollow defect in a line image which is caused due to a hardness of a single layer belt. (3) It is a belt having a comparatively lower Young's modulus, in which a rubber or an elastomer is used, and these belts have a merit that the hollow defect in the line image hardly occurs, due to the softness. Moreover, since a mistracking is prevented by making a width of the belt to be more than (a width of) a driving roll and a tension roll, and by using elasticity (flexibility) of a belt-ear portion which is protruded from the roll, a rib or a mistracking preventing unit is not necessary, and a low cost is realized.

A resin such as a fluororesin, a polycarbonate resin, a polyimide resin, and the like have hitherto been used for the intermediate transfer belt. However, in recent years, an elastic belt in which all layers of the belt or a part of the belt is made of an elastic member has been used. The following problem is to be faced in transfer of a color image using a resin belt.

The color image is generally formed of colored toners of four colors. In one color image, one to four toner layers are formed. The toner layer is subjected to a pressure when passed through the primary transferring (transferring from the photoconductor to the intermediate transfer belt) and the secondary transferring (transferring from the intermediate transfer belt to a sheet), and a cohesive force of the toners becomes high (is increased). When the cohesive force of the toners becomes high, a phenomenon of a hollow defect of characters, and a missing edge (edge defect) of a beta portion image is susceptible to occur. Hardness of the resin belt being high, the resin belt is not deformed according to the toner layer. Therefore, the toner layer can be compressed easily, and the phenomenon of hollow defect of characters is susceptible to occur.

Moreover, nowadays, there has been an increased demand for forming a full-color image on various papers such as a Japanese paper and a paper which is intentionally provided with an asperity. However, in a paper having an inferior surface planarity, there tend to be a gap between the toner (and the paper surface) at the time of transferring, and a defect of transferred colorant (void) is susceptible to occur. When a transferring pressure of a secondary transferring section is raised (increased) for improving an adhesion, a condensation force of the toner layer is increased (becomes high), and results in causing the hollow defect of characters as mentioned above.

The elastic belt is used for the following object. The elastic belt is deformed according to the toner layer in the transferring section, and according to a paper having an inferior surface planarity. In other words, since the elastic belt is deformed following local asperity, the transferring pressure is not raised excessively with respect to the toner layer, and it is possible to achieve a transferred image with a favorable adhesion and without the hollow defect of characters, and having an excellent uniformity with respect to a paper having an inferior planarity.

As a resin of the belt, for example, a resin selected from a group of polycarbonate, fluororesins (ETFE, PVDF), polystyrene, chloropolystyrene, poly-α-methylstyrene, styrene resins (homopolymers or copolymers containing styrene or a substitute of styrene) such as styrene-butadiene copolymers, styrene-vinyl chloride copolymers, styrene-vinyl acetate copolymers, styrene-maleic acid copolymers, styrene-acrylic ester copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-ester methacrylate copolymers (such as styrene-methyl methacrylate copolymers, styrene-ethyl methacrylate copolymers, and styrene-phenyl methacrylate copolymers), styrene-α-chloromethyl acrylate copolymers, styrene-acrylonitrile-acrylic ester copolymers, methyl methacrylate resins, butyl methacrylate resins, ethyl acrylate resins, butyl acrylate resins, modified acrylic resins (such as silicone-modified acrylic resins, vinyl chloride modified acrylic resins, and acryl-urethane resins), vinyl chloride resins, styrene-vinyl acetate copolymers, vinyl chloride-vinyl acetate copolymers, rosin-modified maleic acid resins, phenol resins, epoxy resins, polyester resins, polyethylene resins, polypropylene resins, polybutadiene, polyvinylidene chloride resins, ionomer resins, polyurethane resins, silicone resins, ketone resins, ethylene-ethylacrylate copolymers, xylene resins, polyvinyl butyral resins, polyamide resins, and modified polyphenylene oxide resins can be used singly or in combination of two or more. However, it is needless to mention that the resin for the elastic belt is not restricted to the materials mentioned above.

An elastic material rubber or an elastomer is not restricted in particular, and can be selected appropriately according to an object. For example, the elastic material rubber or the elastomer selected from a group of butyl rubber, fluorine-based rubber, acryl rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, hydrogenated nitrile rubber, thermoplastic elastomers (such as polystyrene-based, polyolefin-based, polyvinyl chloride based, polyurethane-based, polyamide-based, polyurea, polyester-based, and fluororesin based) can be used singly or in combination of two or more of them.

An electroconductive agent for adjusting resistance is not restricted in particular, and can be selected appropriately according to an object. For example, metal powders such as carbon black, graphite, aluminum, and nickel, electroconductive metallic oxides such as tin oxide, titanium oxide, antimony oxide, indium oxide, potassium titanate, combined oxide of antimony oxide-tin oxide (ATO), combined oxide of indium oxide-tin oxide (ITO), or compounds in which insulating fine particles of compounds such as barium sulfate, magnesium silicate, and calcium carbonate are covered by the electroconductive metallic oxides may be used as the electroconductive agent to adjust resistance. It is needless to mention that the electroconductive agent is not restricted to the electroconductive agents mentioned above.

A surface layer material is required to be a material such that the surface layer prevents the contamination of the photoconductor by the elastic material, and improves a secondary transferring property and a cleaning property by reducing an adhesion of the toner by decreasing a surface friction resistance on a transferring belt surface. For example, it is possible to use a material which improves a lubrication property by decreasing a surface energy, in which a resin such as a polyurethane, a polyester, and an epoxy resin is used singly or in combination of two or more, a powder and particles of a fluororesin, a fluorine compound, carbon fluoride, titanium dioxide, silicon carbide, and the like, singly or in combination of two or more, or by dispersing a combination of particles having different particle diameter. Moreover, it is also possible to use a material in which the surface energy is reduced by forming a fluorine-rich layer by performing a heat treatment as in a fluorine-based rubber material.

A method of manufacturing the belt is not restricted in particular, and examples of the method of manufacturing the belt are a centrifugal forming in which the belt is formed by pouring the material in a rotating cylindrical shaped mold, a spray coating in which a film is formed by spraying a liquid paint (coating), a dipping in which a cylindrical shaped mold is soaked (immersed) in a solution of the material, and then taken out, a casting in which the material is poured in an inner mold and an outer mold, a method in which a compound is wound over a circular cylindrical shaped mold, and performing a cured grinding (vulcanization grinding). However, the method of manufacturing the belt is not restricted to these methods, and it is common to manufacture the belt by combining a plurality of manufacturing methods.

As a method for preventing stretching of the elastic belt, there are methods such as a method in which a rubber layer is formed on a core member resin layer having a low stretching property and a method in which a material which prevents stretching of a core-member layer is added. However, the method for preventing stretching of the elastic belt is not restricted to any specific method.

A material which forms the core member layer is not restricted in particular, and can be selected appropriately according to an object. As a material which forms the core member layer, natural fiber such as cotton and silk, synthetic fiber such as polyester fiber, nylon fiber, acryl fiber, polyolefin fiber, polyvinyl alcohol fiber, polyvinyl chloride fiber, polyvinylidene chloride fiber, polyurethane fiber, polyacetal fiber, polyfluoroethylene fiber, and phenol fiber, inorganic fiber such as carbon fiber and glass fiber, metal fiber such as iron fiber and copper fiber are used, and also in the form of a woven fabric or in the form of a yarn.

The yarn may be a yarn in which one filament or a plurality of filaments is twisted, having any type of twisting such as a single twist yarn, a plied yarn (folded yarn), and a two-ply (two-folded) yarn. Moreover, fibers of materials selected from a group of materials mentioned above may be blended (blended yarn). Furthermore, the yarn can be used upon performing a suitable electroconductivity treatment. Whereas, a fabric woven by any weaving method, such as knit weaving (knitting) can be used, and a union fabric can also be used. It is needless to mention, that the electroconductivity treatment can be carried out thereon.

A manufacturing method for providing the core member layer is not restricted in particular, and can be selected appropriately according to an object. Examples of the manufacturing method for providing the core member layer are a method in which a fabric woven to be cylindrical shaped is put on a dye (metal mold), and a covering layer is provided on this woven fabric, a method in which a fabric woven to be cylindrical shaped is soaked into a liquid rubber, and a protective layer is formed on one surface or both surfaces thereof, and a method in which a thread (yarn) is wound around a dye (metal mold) in a helical (spiral) form at any pitch, and a protective layer is provided thereon.

A thickness of the elastic layer depends on a hardness of the elastic layer, and when the elastic layer is too thick, an expansion and contraction of the surface becomes substantial, and a crack tend to occur on the surface layer. Moreover, excessively thick (thickness approximately 1 mm or more) elastic layer is not preferable, as an extension and contraction of the image becomes substantial due to the substantial expansion and contraction of the surface.

It is preferable that the transferring unit (primary transferring unit and secondary transferring unit) includes at least a transferer which performs a peeling charging of a visible image formed on the latent electrostatic image bearing member (photoconductor), toward a recording medium. The transferring unit may be one or more than one. Examples of the transferer are a corona transferer by corona discharge, a transfer belt, a transfer roller, a pressure transfer roller, an adhesive transferer, and the like.

The recording medium, of which, a plain paper is a typical example, is not restricted in particular provided that an unfixed image upon developing can be transferred to the recording medium, and can be selected appropriately according to an object. A PET base for OHP can also be used.

The fixing includes fixing the visible image transferred to the recording medium, by using the fixing unit. The fixing may be carried out for transfer of image of each toner color to the recording medium, and may be carried out simultaneously (at the same time) in a stacked form for toner of each color.

The fixing unit is not restricted in particular, and can be selected appropriately according to an object. However, it is preferable that the fixing unit is a hitherto known heating and pressurizing unit. Examples of the heating and pressurizing unit are a combination of a heating roller and a pressurizing roller, a combination of the heating roller, the pressurizing roller, and an endless belt.

It is preferable that the heating by the heating and pressurizing unit is 80° C. to 200° C.

In the present invention, according to an object, for example, a hitherto known optical fixing unit (optical fixer)

may be used along with the fixing and the fixing unit, or may be used instead of the fixing and the fixing unit.

Decharging includes decharging by applying a decharging bias to the latent electrostatic image bearing member, and it is preferable that the decharging is carried out by the decharging unit.

The decharging unit is not restricted in particular, and can be selected appropriately from among hitherto known dechargers, provided that the decharger is capable of applying the decharging bias to the latent electrostatic image bearing member. A preferable example of the decharging unit is a decharging lamp, and the like.

The cleaning includes removing an electrophotographic toner which is remained on the latent electrostatic image bearing member, and can be carried out preferably by the cleaning unit.

The cleaning unit is not restricted in particular, and can be selected appropriately from the hitherto known cleaners, provided that the cleaning unit is capable of removing the electrophotographic toner remained on the latent electrostatic image bearing member. Suitable examples of the cleaning unit are a magnetic-brush cleaner, an electrostatic-brush cleaner, a magnetic-roller cleaner, a blade cleaner, a brush cleaner, a web cleaner, and the like.

The recycling includes recycling in the developing unit, of the electrophotographic toner which is removed during the cleaning, and can be suitably carried out by the recycling unit.

The recycling unit is not restricted in particular, and examples of the recycling unit are hitherto known transporting units, and the like.

The controlling includes controlling each of the processes mentioned above, and can be suitably performed by the controlling unit.

The controlling unit is not restricted in particular provided that the controlling unit is capable of controlling an operation of each unit mentioned above, and can be selected appropriately according to an object. Examples of the controlling unit are devices such as a sequencer, a computer, and the like.

Next, an aspect of carrying out the image forming method according to the present invention by the image forming apparatus according to the present invention will be described below while referring to FIG. 2. An image forming apparatus 100 shown in FIG. 2 includes a photoconductor drum 10 (hereinafter, may be referred to as "photoconductor 10") as the latent electrostatic image bearing member, a charging roller 20 as the charging unit, an exposing unit 30 as the exposing unit, a developer unit 40 as the developing unit, an intermediate transferring member 50, a cleaning unit 60 as a cleaning unit having a cleaning blade, and a decharging lamp 70 as the decharging unit.

The intermediate transferring member 50 is an endless belt, and is disposed to be movable in a direction of an array, by three rollers 51 disposed therein, around which the endless belt is stretched (put). A part of (Some of) the three rollers 51 also function as a transfer-bias roller capable of applying a predetermined transfer bias (primary-transfer bias) to the intermediate transferring member 50. A cleaning unit 90 having a cleaning blade is disposed near the intermediate transferring member 50. Moreover, a transfer roller 80 as the transferring unit, capable of applying the transfer bias for transferring (secondary transfer) a developed image (toner image) to a transfer paper 95 which is a final recording medium, is disposed facing the intermediate transferring member 50. Around the intermediate transferring member 50, a corona charger 58 for applying the electric charge to the toner image on the intermediate transferring member 50 is disposed between a contact portion of the photoconductor 10 and the intermediate transferring member 50, and a contact portion of the intermediate transferring member 50 and the transfer paper 95, in a direction of rotation of the intermediate transferring member 50.

The developer unit 40 includes a developing belt 41 as a developer bearing member, a black developing unit 45K, a yellow developing unit 45Y, a magenta developing unit 45M, and a cyan developing unit 45C provided around the developing belt 41. The black developing unit 45K includes a developer accommodating section 42K, a developer supplying roller 43K, and a developing roller 44K. The yellow developing unit 45Y includes a developer accommodating section 42Y, a developer supplying roller 43Y, and a developing roller 44Y. The magenta developing unit 45M includes a developer accommodating section 42M, a developer supplying roller 43M, and a developing roller 44M. The cyan developing unit 45C includes a developer accommodating section 42C, a developer supplying roller 43C, and the developing roller 44C. Moreover, the developing belt 41 is an endless belt, and is rotatably stretched around a plurality of belt rollers. A part of the developing belt 41 is in contact with the photoconductor 10.

Figure 2:
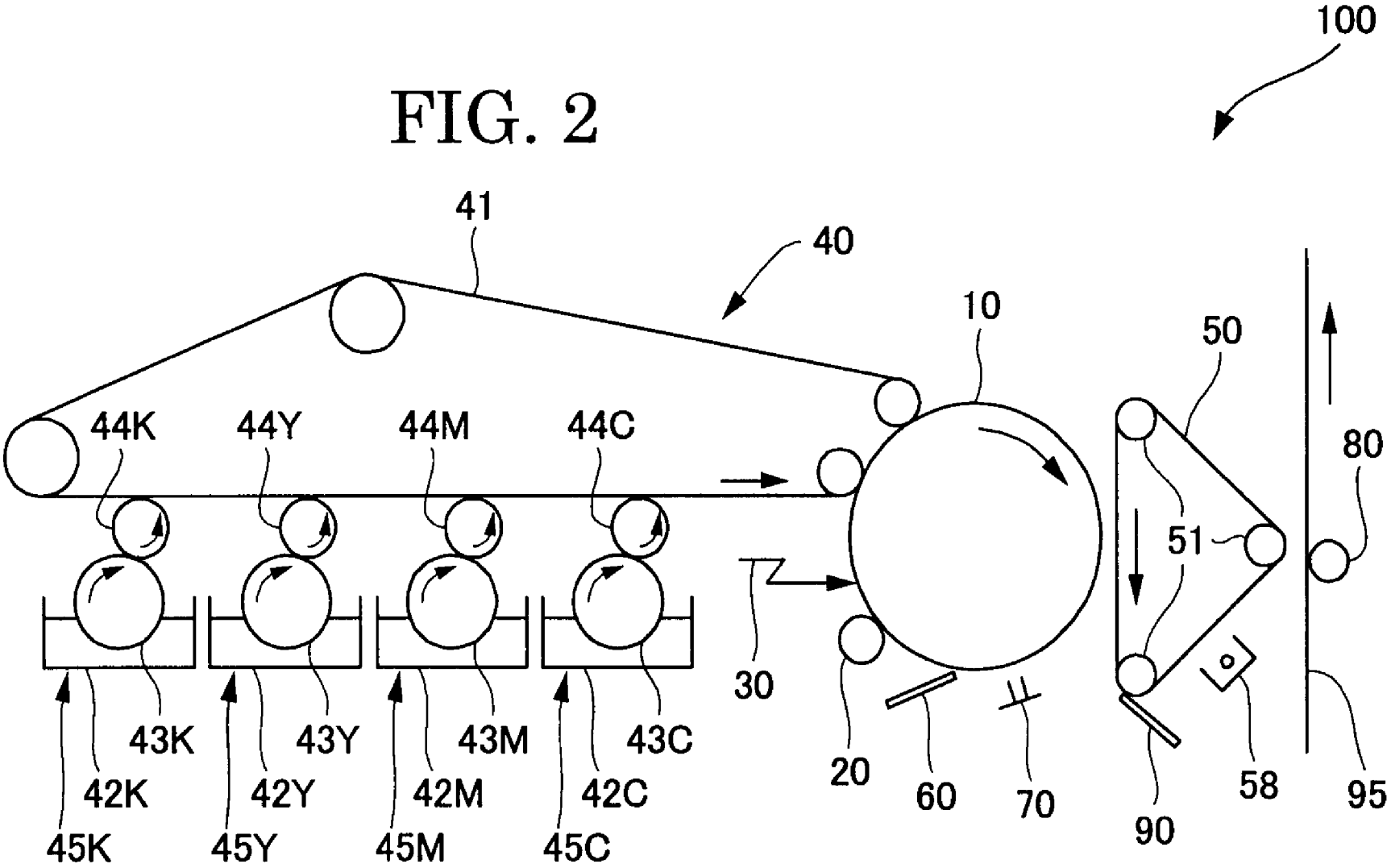
FIG. 2 is a schematic structural view showing an example of an image forming apparatus of the present invention.

In the image forming apparatus 100 shown in FIG. 2, for example, the charging roller 20 charges the photoconductor drum 10 uniformly. The exposing unit 30 carries out an image-wise exposing on the photoconductor drum 10, and forms a latent electrostatic image. The latent electrostatic image formed on the photoconductor drum 10 is developed by supplying the toner from the developer unit 40, and a toner image is formed. The toner image is transfer to the intermediate transferring member 50 (primary transfer) by a pressure applied by the rollers 51, and further transferred to the transfer paper 95 (secondary transfer). As a result of this, a transfer image is formed on the transfer paper 95. The toner remained on the photoconductor 10 is removed by the cleaning unit 60, and the charging of the photoconductor is eliminated once by the decharging lamp 70.

Figure 3:
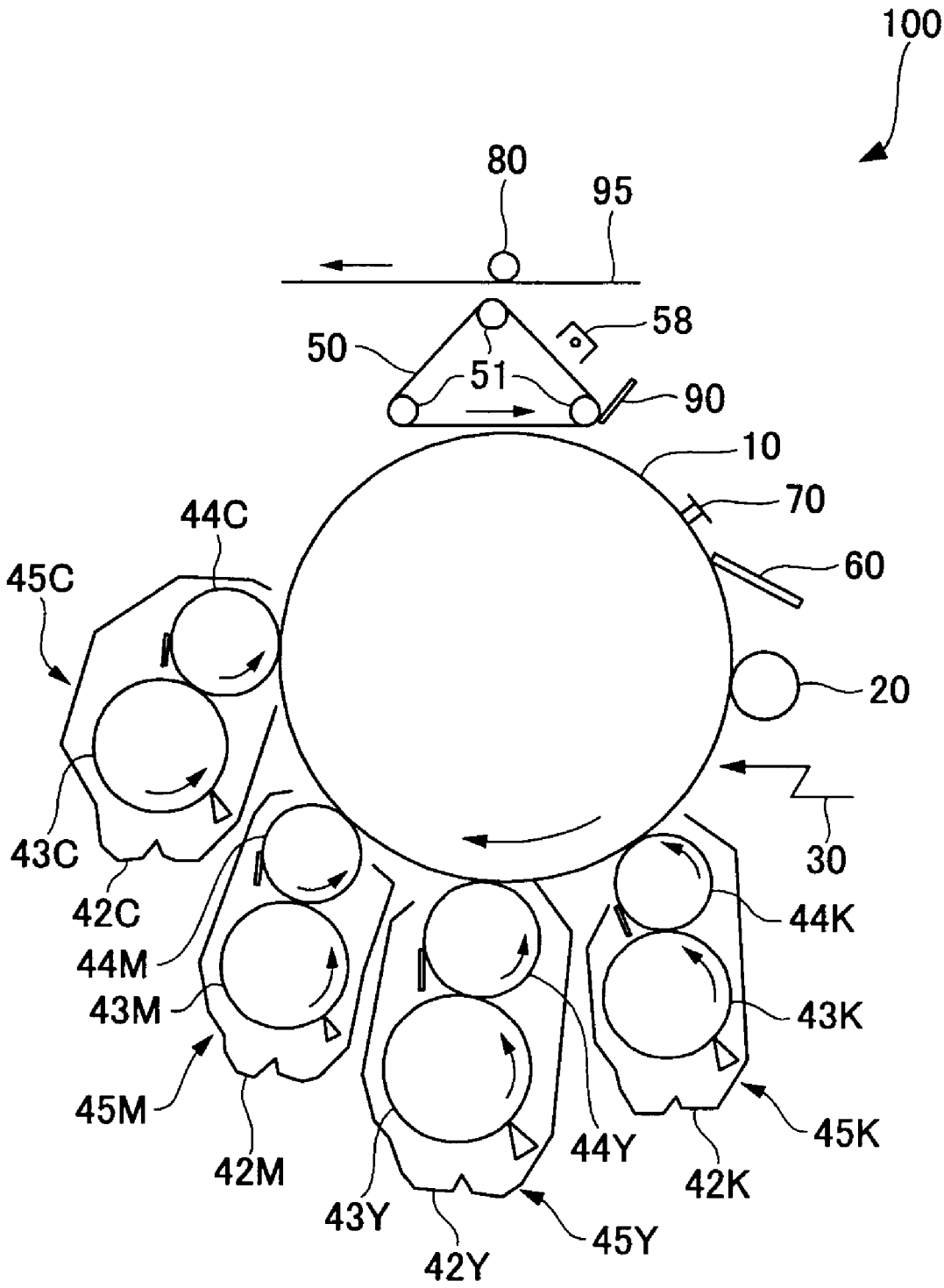
FIG. 3 is a schematic structural view showing another example of an image forming apparatus of the present invention.

Another aspect of carrying out the image forming method according to the present invention by the image forming apparatus according to the present invention will be described below while referring to FIG. 3. An image forming apparatus 100 shown in FIG. 3 has a structure similar to a structure of the image forming apparatus 100 shown in FIG. 3 except for points that the developing belt 41 is not provided, and that the black developing unit 45K, the yellow developing unit 45Y, the magenta developing unit 45M, and the cyan developing unit 45C are disposed to be facing directly, around the photoconductor 10, and have a similar action and effect as the image forming apparatus 100 shown in FIG. 2. In FIG. 3, same reference numerals are assigned to components which are same as in FIG. 2.

Figure 4:
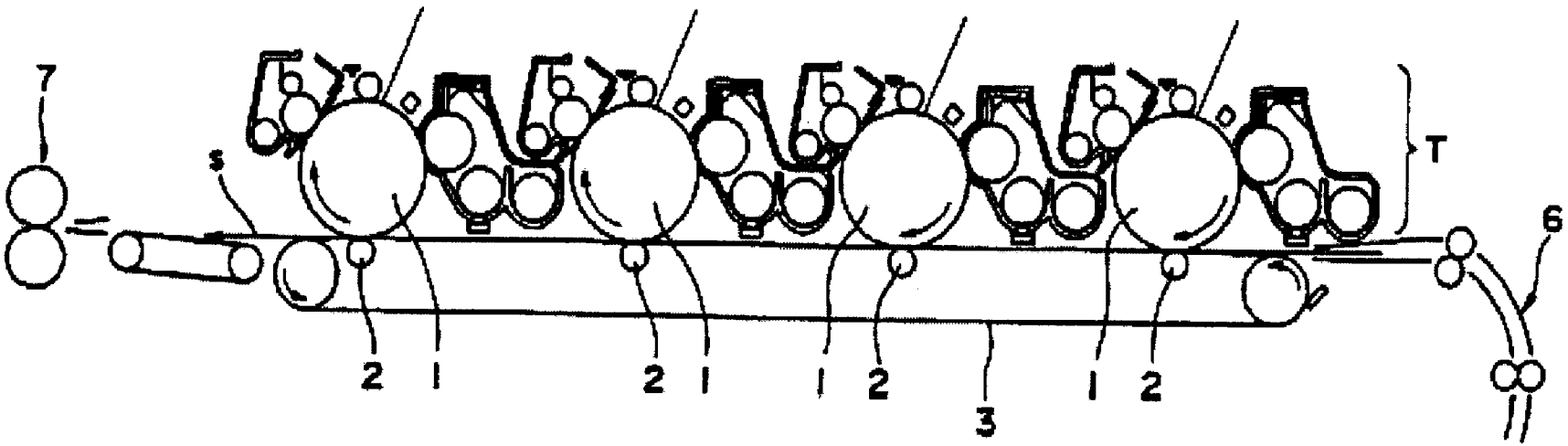
FIG. 4 is a schematic structural view showing still another example of an image forming apparatus of the present invention.
Figure 5:
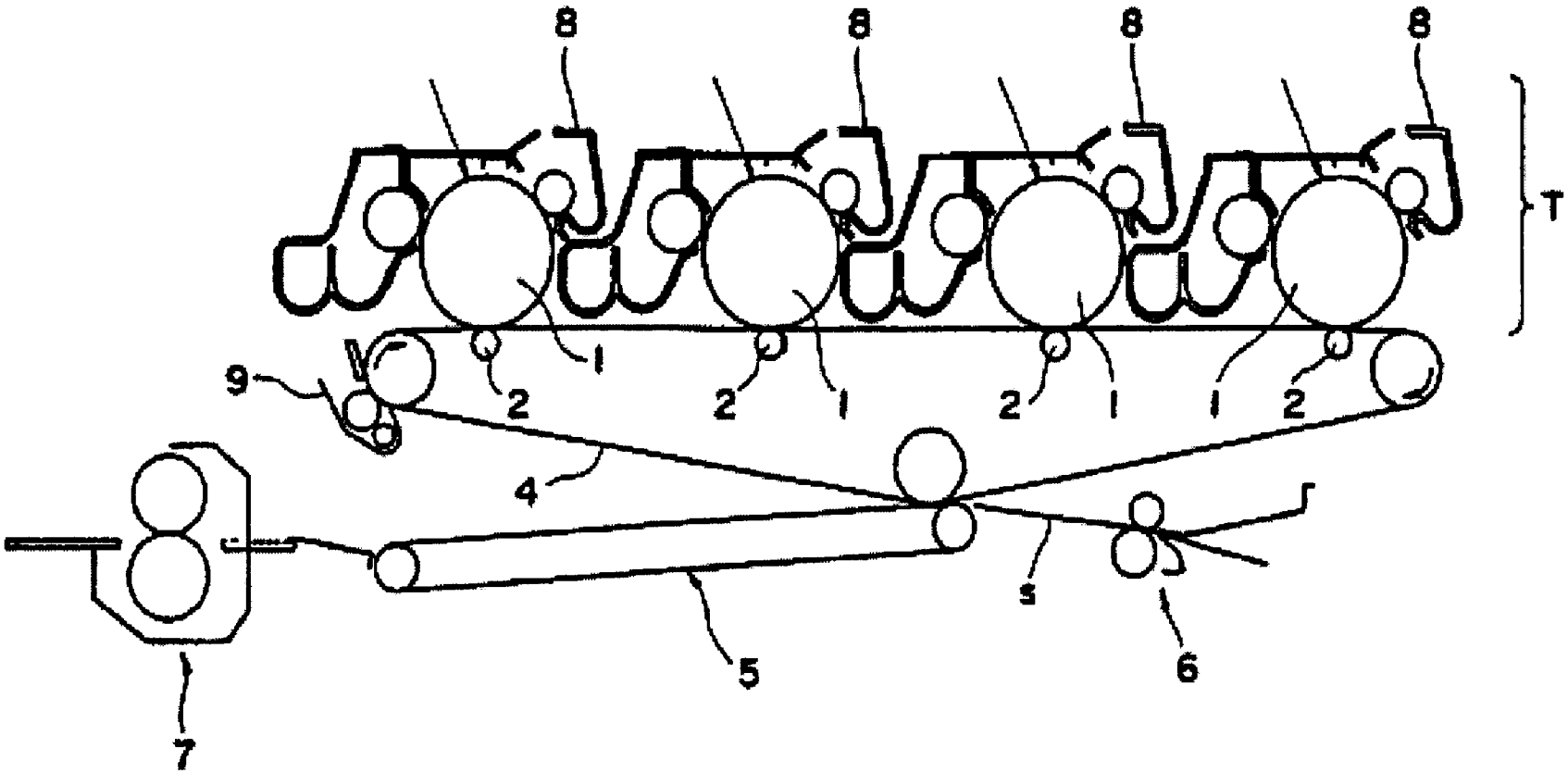
FIG. 5 is a schematic structural view showing still another example of an image forming apparatus of the present invention.

A tandem electrophotographic apparatus which carries out the image forming method according to the present invention by the image forming apparatus according to the present invention, is of two types namely a direct-transfer tandem electrophotographic apparatus in which, an image on each photoconductor 10 is transferred one after another to a sheet s which is transported (carried) by a sheet transporting belt 3, as shown in FIG. 4, and an indirect-transfer tandem electrophotographic apparatus in which, after the image on each photoconductor 10 is transferred one after another to an intermediate transferring member 4 once, by a primary transferer 2, the image on the intermediate transferring member 4 is collectively transferred to the sheet s by a secondary transferer 5 as shown in FIG. 5. The transferring unit (secondary transferer) 5 is a transfer carrier belt, which may also be in a roller form.

When the direct-transfer electrophotographic apparatus and the indirect-transfer electrophotographic apparatus are compared, the former (direct-transfer electrophotographic apparatus) has the following drawback. A paper feeding unit 6 is to be provided at an upstream side of a tandem image forming apparatus T, and a fixing unit 7 at a downstream side of the tandem image forming apparatus T, and due to this, there is an increase in a size in a sheet transporting direction. Whereas, in the latter, a secondary transfer position can be set up comparatively freely. The paper feeding unit and the fixing unit 7 can be disposed overlapping with the tandem image forming apparatus T, and there is a merit of a possible reduction in the size.

Moreover, in the former, the fixing unit 7 is to be disposed close to the tandem image forming apparatus T, so that the size is not increased in the sheet transporting direction. Therefore, the fixing unit cannot be disposed with a sufficient room for the sheet s to be bent, and due to an impact (which is particularly remarkable for a thick sheet) when a front end of the sheet s enters the fixing unit 7, a difference between a sheet transporting speed while passing (through) the fixing unit 7, and a sheet transporting speed of the transfer carrier belt, there is a drawback (demerit) that the fixing unit 7 tends to have an effect on an image forming at the upstream side. Whereas, in the latter, since it is possible to dispose the fixing unit 7 with the sufficient room such that the sheet s can be bent, it is possible to make an arrangement such that the fixing unit 7 has almost no effect on the image formation.

For the abovementioned reasons, recently, the tandem electrophotographic apparatuses, particularly the indirect-transfer tandem electrophotographic apparatuses have been attracting the attention.

Moreover, in this type of color electrophotographic apparatus, as shown in FIG. 5, toner remained after transferring on the photoconductor 1 after the primary transfer is removed by a photoconductor cleaning unit 8, and a surface of the photoconductor 1 is cleaned, and kept ready for the subsequent image forming. Moreover, the toner remained upon transferring on the intermediate transferring member 4 after the secondary transfer is removed by an intermediate transferring member cleaning unit 9, and a surface of the intermediate transferring member 4 is cleaned, and kept ready for the subsequent image forming.

Figure 6:
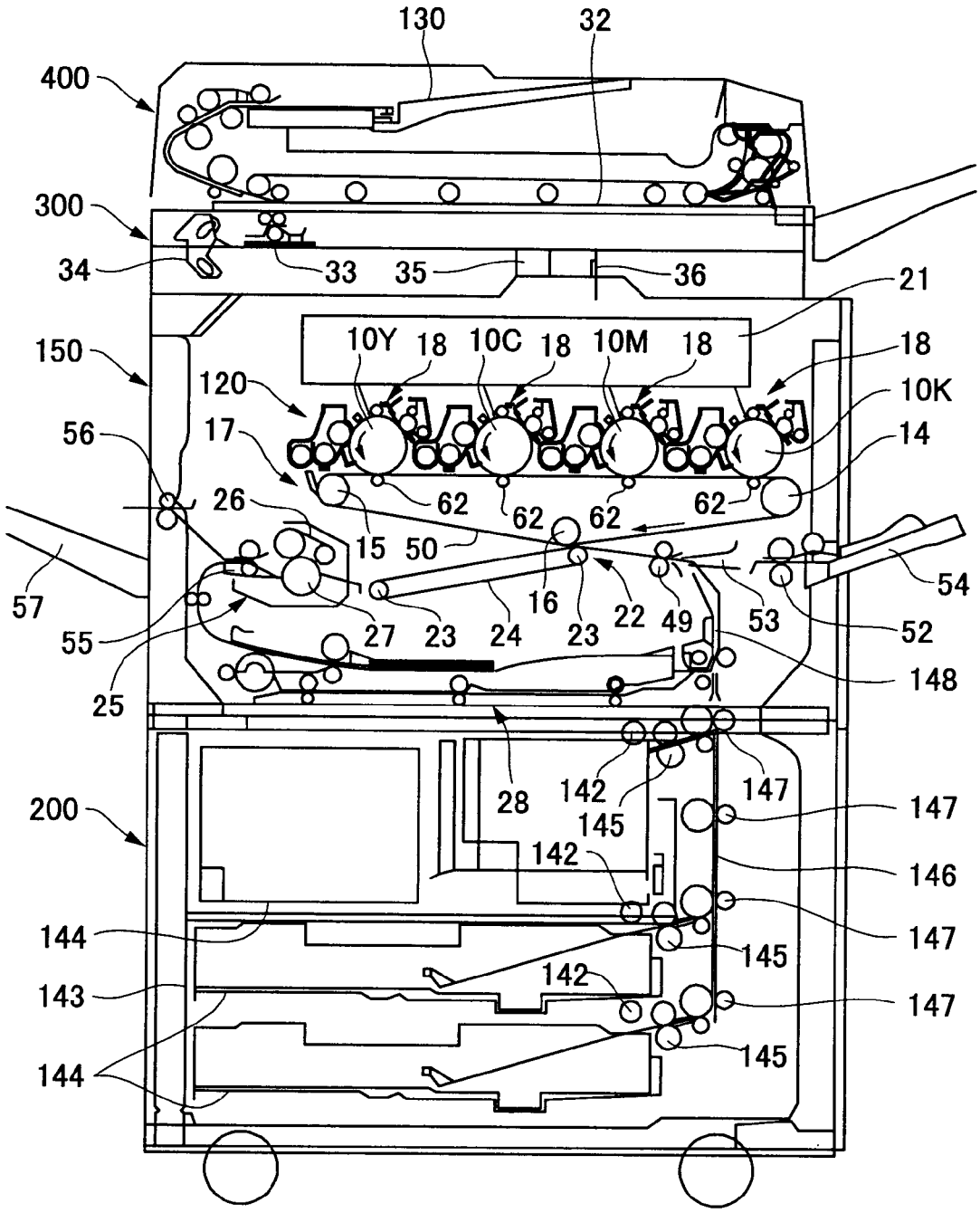
FIG. 6 is a schematic structural view of another example of a tandem image forming apparatus of the present invention.

A tandem image forming apparatus 100 shown in FIG. 6 is a tandem color image forming apparatus. The tandem image forming apparatus 100 includes a copier main body 150, a paper feeding table (apparatus) 200, a scanner 300, and an automatic document feeder (ADF) 400.

The copier main body 150 is provided with the intermediate transferring member 50 in the form of an endless belt, at the central portion. The intermediate transferring member 50 is stretched over supporting rollers 14, 15, and 16, and is rotatable in a clockwise direction in FIG. 6. An intermediate transferring member cleaning unit 17 for removing the toner remained on the intermediate transferring member 50 is disposed near the supporting roller 15. A tandem developer unit 120 in which, for image forming units 18 for yellow, cyan, magenta, and black are arranged facing, is disposed along the transporting direction thereof, on the intermediate transferring member 50. An exposing unit 21 is disposed near the tandem developer unit 120. A secondary transferer 22 is disposed on a side of the intermediate transferring member, opposite to a side at which the tandem developer unit 120 is disposed. In the secondary transferer 22, a secondary transfer belt 24 which is an endless belt is stretched over a pair of rollers 23, a transfer paper which is to be transported on the secondary transfer belt 24, and the intermediate transferring member 50 can make a mutual contact. A fixing unit 25 is disposed near the secondary transferer 22.

In the tandem image forming apparatus 100, a sheet reversing unit (sheet inverting unit) 28 for reversing (inverting) the transfer paper for carrying out the image formation on both sides of the transfer paper is disposed near the second transferer 22 and the fixing unit 25.

Next, formation of a full color image (color copy) using the tandem developer unit 120 will be described below. First of all, a document is set on a document feed tray 130 of the automatic document feeder (ADF) 400, or the document is set on a contact glass 32 of the scanner 300 upon opening the automatic document feeder 400, and the automatic document feeder 400 is closed.

When a start switch (not shown in the diagram) is pressed, in a case of setting the document in the automatic document feeder 400, after the document is transported and moved on to the contact glass 32, whereas in a case of setting the document on the contact glass 32, immediately after the document is set, the scanner 300 is operated (driven) and a first scanning component 33 and a second scanning component 34 travel. At this time, due to the first scanning component 33, light from a light source is irradiated and a light reflected from a document surface is reflected at a mirror in the second scanning component 34. The light reflected at the second scanning component 34 is passed through an image forming lens 35 and received at a reading sensor 36. Thus the color document (color image) is read and let to be image information of black, yellow, magenta, and cyan (colors).

Figure 7:
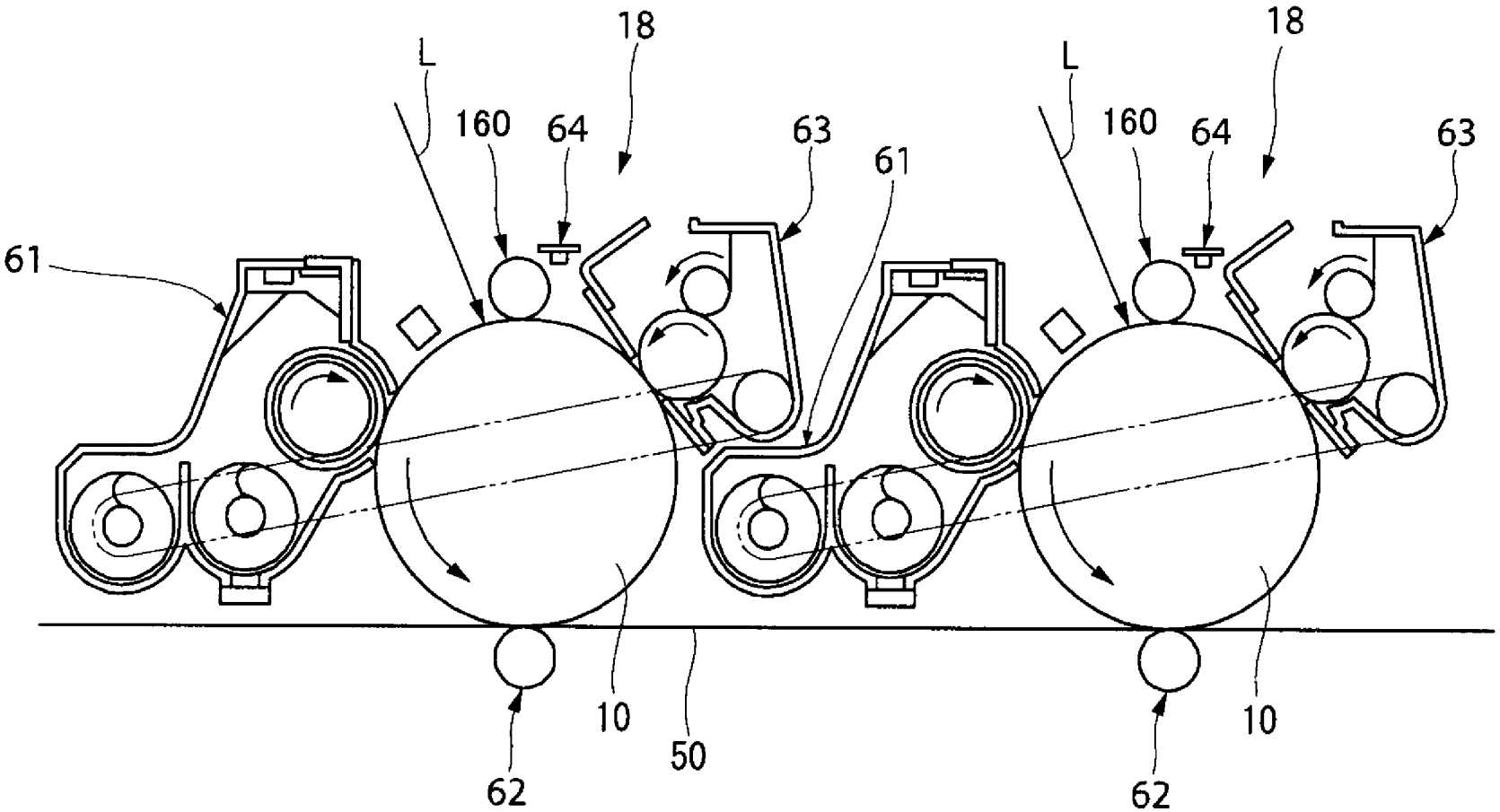
FIG. 7 is a partially enlarged view of FIG. 6.

Color information of each of black, yellow, magenta, and cyan is transmitted to each image forming unit 18 (image forming unit for black, image forming unit for yellow, image forming unit for magenta, and image forming unit for cyan) in the tandem developer unit 120, and a toner image of each of black, yellow, magenta, and cyan is formed in the respective image forming unit. In other words, each image forming unit 18 (image forming unit for black, image forming unit for yellow, image forming unit for magenta, and image forming unit for cyan) in the tandem developer unit 120, as shown in FIG. 7, includes photoconductors 10 (photoconductor for black 10K, photoconductor for yellow 10Y, photoconductor for magenta 10M, and photoconductor for cyan 10C), a charger 160 which charges the photoconductor uniformly, an exposing unit which exposes the photoconductor image-wise corresponding to each color image based on each color information (L in FIG. 7), and which forms a latent electrostatic image corresponding to each color image on the photoconductor, a developer unit 61 which develops the latent electrostatic image by each toner (black toner, yellow toner, magenta toner, and cyan toner), and forms a toner image by each color toner, a transfer charger 62 for transferring the toner images to the intermediate transferring member 50, a photoconductor cleaning unit 63, and a decharger 64, and it is possible to form a single color image of each color (black image, yellow image, magenta image, and cyan image) based on the image information of the respective color. The black image, the yellow image, the magenta image, and the cyan image formed in such manner, (in other words) the black image formed on the photoconductor for black 10K, the yellow image formed on the photoconductor for yellow 10Y, the magenta image formed on the photoconductor for magenta 10M, and the cyan image formed on the photoconductor for cyan 10C are transferred one after another (primary transfer) to the intermediate transferring member 50 which is rotated by supporting rollers 14, 15, and 16. Next, the black image, the yellow image, the magenta image, and the cyan image are superimposed on the intermediate transferring member 50, and a composite color image (color transfer image) is formed.

On the other hand, in the paper feeding table 200, one of paper feeding rollers 142 is selectively rotated, and a sheet (recording paper) is let out from one of paper feeding cassettes 142 which are provided in multiple stages in a paper bank 143. One paper at a time is separated by a separating roller 145, and is sent to a paper feeding path 146. Further, the paper is transported (carried) by a transporting roller 147, then guided to a paper feeding path 148 inside the copier main body 150, and is stopped by allowing to abut against a resist roller 49. Or, the paper feeding roller 142 is rotated and sheets (recording papers) in a bypass tray 54 are let out. One sheet at a time is separated by the separating roller 145 and is inserted (put) into a bypass paper feeding path 53, and is stopped in the same manner by allowing to abut against the resist roller 49. The resist roller 49 is generally used upon connecting to the ground, but may be used in a state of a bias applied thereon for removing paper dust of the sheet. Further, the resist roller 49 is rotated upon matching the timing with the composite color image (color transfer image) which is combined on the intermediate transferring member 50, and the sheet (recording paper) is sent between the intermediate transferring member 50 and the secondary transferer 22. By transferring (secondary transfer) the composite color image (color transfer image) to the sheet (recording paper) by the secondary transferer 22, the color image is transferred to and formed on the sheet (recording paper). The toner remained on the intermediate transferring member 50 after transferring the image is cleaned by the intermediate transferring member cleaning unit 17.

The sheet (recording paper) with the color image transferred to and formed thereon is transported by the secondary transferer 22 and is sent to the fixing unit 25. In the fixing unit 25, by heat and pressure, the composite color image (color transfer image) is fixed on the sheet (recording paper). After fixing the composite color image on the sheet, the sheet (recording paper) is switched (shifted) by a switch blade 55, and is discharged by a discharge roller 56. The discharged sheet is stacked in a paper discharging tray 57. After switching (shifting) the sheet by the switch blade 55, the sheet is reversed (inverted) by the sheet reversing unit 28, and is again guided to a transfer position. After recording an image also on a reverse surface, the sheet is discharged by the discharge roller 56, and is stacked in the paper discharging tray 57.

In the image forming method and the image forming apparatus according to the present invention, since the toner according to the present invention which is capable of having both the excellent (superior) low-temperature fixing property and the offset resistance property, it is possible to form efficiently an high quality image.

According to the present invention, it is possible to solve heretofore problems, and to have both the excellent low-temperature fixing property, and the offset resistance property. Therefore, it is possible to provide a toner which can form a favorable highly-defined image, a developer in which this toner is used, a toner container, a process cartridge, an image forming apparatus, and an image forming method.

EXAMPLES

Examples of the present invention will be described below. However, the present invention is not restricted to these examples. In the following examples, 'parts' and 'percent (%)' are mass-basis except where specifically noted.

Moreover, in the following examples and comparative examples, measurement of 'the weight-average particle diameter (Dw) and the particle distribution (Dw/Dn) of the toner', 'the content of isocyanate group (NCO %)', 'the acid value and the hydroxyl value', 'the glass transition temperature (Tg)', 'the content of Ti, Bi, and Sn', was carried out as described below.

<Weight-Average Particle Diameter (Dw) and Particle Size Distribution (Dw/Dn)>

The weight-average particle diameter (Dw) and the number-average particle size diameter (Dn) of the toner were measured by using the particle-size measuring instrument ("MULTISIZER III, manufactured by Beckman-Coulter Inc.), with the aperture diameter of 100 μm, and the analysis was carried out by the analysis software (Beckman Coulter Multisizer 3, Version 3.51). Concretely, 0.5 ml of a surfactant having 10 percent by mass (alkyl benzene sulfonate, NeoGen SC-A manufactured by DAI-ICHI KOGYO SEIYAKU CO., LTD.) was added to a 100 ml glass beaker, then 0.5 g of each toner was added, and the mixture was stirred with a micro spatula. Further, 80 ml of ion-exchange water was added. A dispersion (dispersing liquid) obtained was subjected to a dispersion treatment for 10 minutes in an ultrasonic disperser (W-113MK-II, manufactured by HONDA ELECTRONIC CO., LTD.). The dispersion was measured by using the MULTISIZER-III, by using ISOTONE III (manufactured by Beckman-Coulter Inc.) as a solution for the measurement. For the measurement, the toner sample dispersion was dripped such that a concentration indicated by the device was 8±2%. In this measurement method, from a point of view of reproducibility of measurement of the particle diameter, it is important that the concentration is let to be 8±2%. In this concentration range, no error occurs in the particle diameter.

<Measurement of Percentage Content of Free Isocyanate Group (NCO %)>

The percentage content of the free isocyanate group (NCO %) was measured by a method according to JIS K1603.

<Methods for Measuring Acid Value and Hydroxyl Value>

—Method for Measuring Acid Value—

The acid value was measured under the following conditions, based on a measurement method described in JIS K0070-1992.

Sample preparation: 0.5 g (0.3 g in ethyl acetate soluble element (part)) of toner was added to 120 ml of toluene at room temperature (23° C.), and was dissolved by stirring for approximately 10 hours. Further, 30 ml of ethanol was added, and this mixture was let to be a sample solution.

Although the measurement can be done by calculating by an instrument mentioned above, concretely the calculation is carried out in the following manner. A titration was carried out by an N/10 standardized caustic potash alcohol solution in advance, and the acid value was determined (calculated) from an amount consumed of an alcohol potassium liquid, by the following calculation expression (formula).

$$\text{Acid value}=\text{KOH(ml number)}\times N\times 56.1/\text{sample mass}$$

(where, N is a factor of N/10 KOH).

—Method for Measuring Hydroxyl Value—

0.5 g of a sample is weighed precisely in a 100 ml measuring flask, and 5 ml of an acetylation reagent is added correctly to this sample. After this, the mixture is immersed in a bath of temperature 100° C.±5° C., and heated. After one to two hours, the flask is removed from the bath. Water is added after leaving the mixture in the flask to cool down, and acetic anhydride is decomposed by shaking. Next, to decompose completely, the flask is once again heated in the bath for 10 minutes or more, and after leaving the flask for cooling down, a wall of the flask is washed properly by an organic solvent. This liquid is subjected to potentiometric titration by N/2 potassium hydroxide ethyl alcohol solution, by using an electrode, and the hydroxyl value is determined (according to JIS K0070-1966).

<Glass Transition Temperature>

The glass transition temperature (Tg) is concretely determined by the following procedure. TA-60WS and DSC-60 manufactured by Shimadzu Seisakusho Co., Ltd. were used as measuring instruments, and the measurement was carried out under the measurement conditions shown below.

[Measurement Conditions]

Sample container: Sample pan (having a lid) made of aluminum

Sample amount: 5 mg

Reference: Sample pan made of aluminum (alumina 10 mg)

Atmosphere: Nitrogen (flow rate 50 ml/min)

Temperature conditions

Start temperature: 20° C.

Programming rate: 10° C./min

End temperature: 150° C.

Hold time: Nil

Cooling rate: 10° C./min

End temperature: 20° C.

Hold time: Nil

Programming rate: 10° C./min

End temperature: 150° C.

A result of the measurement was analyzed by using data analysis software (TA-60, Version 1.52) manufactured by Shimadzu Seisakusho Co., Ltd. As a method for analyzing, a range of ±50° C. was specified with a point showing a maximum peak on the lowest temperature side of a DrDSC curve which is a DSC differential curve of a temperature rise for a second time, and a peak temperature is determined by using a peak analysis function of the analysis software. Next, a maximum endothermic temperature of the DSC curve is determined by using the peak analysis function of the analysis software in a range of the peak temperature +5° C. and the peak temperature of −5° C. with the DSC curve. The temperature shown here is equivalent to the glass transition temperature (Tg) of the toner.

<Measurement of Content of Ti, Bi, and Sn in Toner>

The content of Ti, Bi, and Sn in the toner was measured by an X-ray fluorescence measuring instrument (ZSX-100E manufactured by Rigaku Corporation).

Example 1

—Preparation of Organic Fine-Particles Emulsion—

In a reaction vessel equipped with a stirrer and a thermometer, were placed 683 parts of water, 11 parts of a sodium salt of ethylene oxide methacrylate adduct sulfuric ester ("ELEMINOL RS-30 manufactured by Sanyo Chemical Industries, Ltd.), 83 parts of styrene, 83 parts of methacrylic acid, 110 parts of butyl acrylate, and 1 part of ammonium persulfate, and the mixture was stirred at 400 rpm (rotations per minute) for 15 minutes to yield a white emulsion. The emulsion was heated and the temperature was raised up to a system temperature of 75° C., and allowed to react for five hours. Next, 30 parts of 1% ammonium persulfate aqueous solution was added. The mixture was cured (aging) for five hours at 75° C. and an aqueous dispersion of a vinyl resin (a copolymer of styrene-methacrylic acid-butyl acrylate-sodium salt of ethylene oxide methacrylate adduct sulfuric ester). This is let to be 'fine-particles dispersion 1'.

The weight-average particle diameter of the fine particles in the 'fine-particles dispersion 1', when measured by a particle-size distribution analyzer ('LA-920' manufactured by HORIBA, Ltd.) in which a laser light scattering is used, was 105 nm. Moreover, a part of the 'fine-particles dispersion 1' was dried, and the resin component was isolated (separated). The glass transition temperature (Tg) of the resin component was 59° C., and the weight-average molecular weight (Mw) was 150000.

—Preparation of Aqueous Phase—

A milk-white liquid was obtained by mixing and stirring 990 parts of water, 83 parts of the 'fine-particles dispersion 1', 37 parts of 48.5% aqueous solution of sodium dodecyl diphenyl ether disulfonate ("ELEMINOL MON-7 manufactured by Sanyo Chemical Industries, Ltd), and 90 parts of ethyl acetate. This milk-white liquid is let to be 'aqueous phase 1'.

—Preparation of Low Molecular Weight Polyester—

In a reaction vessel equipped with a cooling pipe, a stirrer, and a nitrogen feeding tube, were placed 229 parts of ethylene oxide two-mole adduct of bisphenol A, 529 parts of propylene oxide three-mole adduct of bisphenol A, 208 parts of terephthalic acid, 46 parts of adipic acid, and 2 parts of dibutyl tin oxide, and the mixture was allowed to react at 230° C. for eight hours, under a normal pressure. Next, after the mixture was allowed to react under a reduced pressure of 10 mm Hg to 15 mm Hg, 44 parts of trimellitic anhydride was added to the reaction vessel, and allowed to react at 180° C. for two hours under the normal pressure, to yield a 'low molecular weight polyester 1'.

The 'low molecular weight polyester 1' obtained had the glass transition temperature (Tg) of 43° C., the weight-average molecular weight (Mw) of 6700, the number-average molecular weight of 2500, and the acid value of 25 mg KOH/g.

—Preparation of Prepolymer 1—

In a reaction vessel equipped with a cooling pipe, a stirrer, and a nitrogen feeding tube, were placed 463 parts of propylene glycol, 657 parts of terephthalic acid, 96 parts of trimellitic anhydride, and 2 parts of titanium tetrabutoxide, and the mixture was allowed to react at 230° C. for eight hours, under a normal pressure. Next, the mixture was allowed to react under reduced pressure of 10 mm Hg to 15 mm Hg for five hours, and an 'intermediate polyester 1' was obtained.

The 'intermediate polyester 1' obtained had the weight-average molecular weight 28000, the glass transition temperature (Tg) 36° C., the acid value 0.5 mg KOH/g, and the hydroxyl value 16.5.

Next, in a reaction vessel equipped with a cooling pipe, a stirrer, and a nitrogen feeding tube, were placed 250 parts of the 'intermediate polyester 1', 18 parts of isophorone diisocyanate, 250 parts of ethyl acetate, and 2 parts of a Bi-based catalyst (NEOSTANN U-600 manufactured by NITTO KASEI CO., LTD. The mixture was allowed to react at 100° C. for 15 hours, and a 'prepolymer 1' was obtained.

Percent by mass of isocyanate in the 'prepolymer 1' obtained was 0.61%.

—Preparation of Ketimine—

In a reaction vessel equipped with a stirrer and a thermometer, were placed 170 parts of isophorone diamine and 150 parts of methyl ethyl ketone. The mixture was allowed to react at 50° C. for five hours, and a 'ketimine 1' was prepared. The 'ketimine 1' obtained had an amine value of 416.

—Preparation of MB (Master Batch)—

A mixture of 1200 parts of water, 540 parts of carbon black (Printex 35, manufactured by Deggsa Co., Ltd.) [having DBP oil absorbance of 42 ml/100 mg, pH of 9.5], 1200 parts of a polyester resin was mixed by HENSCHEL MIXER (manufactured by Mitsui Mining Co., Ltd.). After the mixture was kneaded for 30 minutes at 150° C. using a two-roll mill, the mixture was cold-rolled and pulverized in a pulverizer, and a 'master batch 1' was prepared.

—Preparation of Oil Phase—

In a reaction vessel equipped with a stirrer and a thermometer, were placed 378 parts of the 'low molecular weight polyester 1', 110 parts of carnauba wax, 22 parts of CCA (metal complex salicylic acid E-84, manufactured by Orient Chemical Industries, Ltd.), and 947 parts of ethyl acetate. The mixture was heated to 80° C. while stirring, and after leaving the mixture at 80° C. for five hours, the mixture was cooled down to 30° C. in one hour. Next, 500 parts of the 'master batch 1' and 500 parts of the ethyl acetate were added to the reaction vessel, and the mixture was mixed for one hour to yield a dissolved material. This is let to be a 'raw material solution 1'.

Next, 1324 parts of the 'raw material solution 1' was transferred to the reaction vessel, and by using a bead mill (ULTRAVISCO MILL manufactured by Aimex Co., Ltd.), carbon black and wax were dispersed under the conditions namely, liquid (solution) sending speed: 1 kg/hr, disc circumferential velocity: 6 m/sec, amount of 0.5 zirconia beads filled: 80% by volume, number of passes: 3.

Next, 1324 parts of 65 percent by mass of ethyl acetate solution of the 'low molecular weight polyester 1' was added, and by using the bead mill with the same conditions as mentioned above, and with the number of passes: 1, a dispersion was obtained. This dispersion is let to be a 'pigment and wax dispersion 1'.

A solid concentration (at 130° C. for 30 minutes) of the 'pigment and wax dispersion 1' obtained was 50 percent by mass.

—Emulsification—

749 parts of the 'pigment and wax dispersion 1', 115 parts of the 'prepolymer 1', and 2.5 parts of the 'ketimine 1' were placed in a vessel, and the mixture was mixed for one minute at 5000 rpm by using a TK HOMO MIXER (manufactured by Tokushu Kika Kogyo Co., Ltd.). Next, 1200 parts of the 'aqueous phase 1' were added to the reaction vessel, and the mixture was mixed for 20 minutes at 13000 rpm, by the TK HOMO MIXER to yield an aqueous catalyst dispersion. The aqueous catalyst dispersion is let to be an 'emulsified slurry 1'

—Removal of Organic Solvent—

The 'emulsified slurry 1' was placed in a reaction vessel equipped with a stirrer and a thermometer. After the solvent was removed at 30° C. for eight hours, the slurry was cured (aging) for four hours at 45° C., and a dispersion from which an organic solvent is removed by evaporation was obtained. This dispersion is let to be a 'dispersed slurry 1'.

The 'dispersed slurry 1' obtained had the number-average particle diameter 4.54 μm and the weight-average particle diameter 5.21 μm as measured by the MULTISIZER II (manufactured by Beckman-Coulter Inc.)

—Washing and Drying—

After 100 parts of the 'dispersed slurry 1' was filtered under a reduced pressure, washing and drying were carried out by the following procedure.

(1) 100 parts of ion exchange water was added to the filtered cake. The mixture was mixed by the TK HOMO MIXER (at 12000 rpm for 10 minutes), and then filtered.

(2) 100 parts of distilled water was added to the filtered cake in (1). The mixture was mixed by the TK HOMO MIXER (at 12000 rpm for 30 minutes), and then filtered.

(3) 100 parts of 10% hydrochloric acid was added to the filtered cake in (2). The mixture was mixed by the TK HOMO MIXER (at 12000 rpm for 10 minutes), and then filtered.

(4) 300 parts of ion-exchange water was added to the filtered cake in (3). The mixture was mixed by the TK HOMO MIXER (at 12000 rpm for 10 minutes). Then an operation of filtering was carried out twice and a filtered cake was obtained. The filtered cake obtained was dried at 45° C. for 48 hours in a circulating-air dryer, and then sieved through a 75 μm mesh to obtain a toner. This is let to be a 'toner 1'.

Example 2

—Preparation of Toner 2—

A 'toner 2' was prepared similarly as in Example 1, except for using a 'prepolymer 2' prepared by the following procedure, instead of the 'prepolymer 1', and taking 2.9 parts instead of 2.5 parts of the 'ketimine 1', in Example 1.

—Preparation of Prepolymer 2—

In a reaction vessel equipped with a cooling pipe, a stirrer, and a nitrogen feeding tube, were placed 463 parts of propylene glycol, 657 parts of terephthalic acid, 96 parts of trimellitic anhydride, and 2 parts of titanium tetrabutoxide, and the mixture was allowed to react at 230° C. for six hours at a normal pressure. Next, the mixture was allowed to react under a reduced pressure of 10 mm Hg to 15 mm Hg for three hours, and an 'intermediate polyester 2' was obtained.

The 'intermediate polyester 2' obtained had the weight-average molecular weight of 19000, the glass transition temperature (Tg) of 34° C., the acid value of 0.5 mg KOH/g, and the hydroxyl value of 19.2.

Next, in a reaction vessel equipped with a cooling pipe, a stirrer, and a nitrogen feeding tube, were placed 250 parts of the 'intermediate polyester 2', 21 parts of isophorone diisocyanate, 250 parts of ethyl acetate, and 2 parts of Bi-based catalyst (NEOSTANN U-600 manufactured by NITTO KASEI CO., LTD.). The mixture was allowed to react at 100° C. for 15 hours, and the 'prepolymer 2' was obtained.

Percent by mass of isocyanate in the 'prepolymer 2' obtained was 0.72%.

Example 3

—Preparation of Toner 3—

A 'toner 3' was prepared similarly as in Example 1, except for using a 'prepolymer 3' prepared by the following procedure, instead of the 'prepolymer 1', and taking 3.4 parts instead of 2.5 parts of 'ketimine 1' in Example 1.

—Preparation of Prepolymer 3—

In a reaction vessel equipped with a cooling pipe, a stirrer, and a nitrogen feeding tube, were placed 463 parts of propylene glycol, 657 parts of terephthalic acid, 96 parts of trimellitic anhydride, and 2 parts of titanium tetrabutoxide, and the mixture was allowed to react at 230° C. for five hours at a normal pressure. Next, the mixture was allowed to react under a reduced pressure of 10 mm Hg to 15 mm Hg for three hours, and an 'intermediate polyester 3' was obtained.

The 'intermediate polyester 3' obtained had the weight-average molecular weight of 11000, the glass transition temperature (Tg) of 33° C., the acid value of 0.5 mg KOH/g, and the hydroxyl value of 22.1.

Next, in a reaction vessel equipped with a cooling pipe, a stirrer, and a nitrogen feeding tube, were place 250 parts of the 'intermediate polyester 3', 21 parts of isophorone diisocyanate, 250 parts of ethyl acetate, and 2 parts of Bi-based catalyst (NEOSTANN U-600 manufactured by NITTO KASEI CO., LTD.). The mixture was allowed to react at 100° C. for 15 hours, and the 'prepolymer 3' was obtained.

Percent by mass of isocyanate in the 'prepolymer 3' obtained was 0.84%.

Example 4

—Preparation of Toner 4—

A 'toner 4' was prepared similarly as in Example 1, except for using a 'low molecular weight polyester 2' prepared by the following procedure, instead of the 'low molecular weight polyester 1', in Example 1.

—Preparation of Low Molecular Weight Polyester 2—

In a reaction vessel equipped with a cooling pipe, a stirrer, and a nitrogen feeding tube, were place 229 parts of ethylene oxide two-mole adduct of bisphenol A, 529 parts of propylene oxide three-mole adduct of bisphenol A, 208 parts of terephthalic acid, 46 parts of adipic acid, and 1 part of dibutyl tin oxide, and the mixture was allowed to react at 230° C. for eight hours at a normal pressure. Next, after the mixture was allowed to react under a reduced pressure of 10 mm Hg to 15 mm Hg, 44 parts of trimellitic anhydride was added to the reaction vessel, and allowed to react at 180° C. for two hours at the normal pressure, to yield the 'low molecular weight polyester 2'.

The 'low molecular weight polyester 2' obtained had the glass transition temperature (Tg) of 43° C., the weight-average molecular weight (Mw) of 6700, the number-average molecular weight of 2500, and the acid value of 25 mg KOH/g.

Example 5

—Preparation of Toner 5—

A 'toner 5' was prepared similarly as in Example 4, except for using the 'prepolymer 2' prepared in Example 2, instead of the 'prepolymer 1', and taking 2.9 parts instead of 2.5 parts of the 'ketimine 1' in Example 4.

Example 6

—Preparation of Toner 6—

A 'toner 6' was prepared similarly as in Example 1 (4), except for using the 'prepolymer 3' prepared in Example 3, instead of the 'prepolymer 1', and taking 3.4 parts instead of 2.5 parts of the 'ketimine 1' in Example 4.

Comparative Example 1

—Preparation of Toner 7—

A 'toner 7' was prepared similarly as in Example 1, except for using a 'prepolymer 4' prepared by the following procedure, instead of the 'prepolymer 1', and taking 2.6 parts instead of 2.5 part of the 'ketimine 1', in Example 1.

—Preparation of Prepolymer 4—

In a reaction vessel equipped with a cooling pipe, a stirrer, and a nitrogen feeding tube, were placed 463 parts of propylene glycol, 657 parts of terephthalic acid, 96 parts of trimellitic anhydride, and 2 parts of titanium tetrabutoxide, and the mixture was allowed to react at 230° C. for six hours under a normal pressure. Next, the mixture was allowed to react under a reduced pressure of 10 mm Hg to 15 mm Hg for three hours, and an 'intermediate polyester 4' was obtained.

The 'intermediate polyester 4' obtained had the weight-average molecular weight of 19000, the glass transition temperature (Tg) of 34° C., the acid value of 0.5 mg KOH/g, and the hydroxyl value of 19.2.

Next, in a reaction vessel equipped with a cooling pipe, a stirrer, and a nitrogen feeding tube, were placed 250 parts of the 'intermediate polyester 4', 19 parts of isophorone diisocyanate, and 250 parts of ethyl acetate. The mixture was allowed to react at 100° C. for 72 hours, and the 'prepolymer 4' was obtained.

Percent by mass of isocyanate in the 'prepolymer 4' obtained was 0.64%.

Comparative Example 2

—Preparation of Toner 8—

A 'toner 8' was prepared similarly as in Example 1 except for using a 'prepolymer 5' prepared by the following procedure instead of the 'prepolymer 1', and taking 2.9 parts instead of 2.5 parts of the 'ketimine 1', in Example 1.

—Preparation of Prepolymer 5—

In a reaction vessel equipped with a cooling pipe, a stirrer, and a nitrogen feeding tube, were placed 463 parts of propylene glycol, 657 parts of terephthalic acid, 96 parts of trimellitic anhydride, and 2 parts of dibutyl tin oxide, and the mixture was allowed to react at 230° C. for six hours under a normal pressure. Next, the mixture was allowed to react under a reduced pressure of 10 mm Hg to 15 mm Hg for three hours, and an 'intermediate polyester 5' was obtained.

The 'intermediate polyester 5' obtained had the weight-average molecular weight of 20000, the glass transition temperature (Tg) of 34° C., the acid value of 0.5 mg KOH/g, and the hydroxyl value of 19.1.

Next, in a reaction vessel equipped with a cooling pipe, a stirrer, and a nitrogen feeding tube, were placed 250 parts of the 'intermediate polyester 5', 21 parts of isophorone diisocyanate, and 250 parts of ethyl acetate. The mixture was allowed to react at 100° C. for 15 hours, and the 'prepolymer 5' was obtained.

Percent by mass of isocyanate in the 'prepolymer 5' obtained was 0.71%.

Comparative Example 3

—Preparation of Toner 9—

A 'toner 9' was prepared similarly as in Example 4, except for using the 'prepolymer 4' prepared in Comparative Example 1, instead of the 'prepolymer 1', and taking 2.6 parts instead of 2.5 parts of the 'ketimine 1', in Example 4.

Comparative Example 4

—Preparation of Toner 10—

A 'toner 10' was prepared similarly as in Example 4, except for using the 'prepolymer 5' prepared in Comparative Example 2, instead of the 'prepolymer 1', and taking 2.9 parts instead of 2.5 parts of the 'ketimine 1' in Example 4.

Next, the heat-resistant storage stability, the fixing property, and the charging ability of each of the toners obtained in Example 1 to Example 6, and Comparative Example 1 to Comparative Example 4, were evaluated by the following procedures. Results are shown in Table 2.

<Heat-Resistant Storage Stability>

For each toner, after keeping the toner at 50° C. for eight hours, the toner is sieved through a 42 mesh sieve for two minutes, and a residual ratio on a wire mesh was let to be the heat-resistant storage stability. Lower the residual ratio, superior is the heat-resistant storage stability of the toner. The toner was evaluated in the following four stages.

[Evaluation Criteria]

C: Not acceptable (Not good): 30% or more

B: Doubtful: 20% or more, but less than 30%

A: Acceptable (Good): 10% or more, but less than 20%

AA: Favorable (Very good): less than 10%

<Fixing Property>

Adjustment was made such that each toner of 1.0±0.1 mg/cm$^2$ is developed for a beta image on a transfer paper of a regular (plain paper) and a board paper (TYPE 6200 manufactured by RICOH CO., LTD., and paper for copy printing <135> manufactured by NBS RICOH CO., LTD.) by using an image forming apparatus (imagio Neo 450 manufactured by RICOH CO., LTD.). Adjustment was made such that the temperature of the fixing belt is variable. A temperature at which there is no occurrence of offset, and a lower-limit temperature for fixing with the board paper were measured. Regarding the lower-limit temperature, a temperature of the fixing roll at which, the residual ratio of image density after the fixed image obtained is rubbed by a pad is 70% or more, was let to be the lower-limit temperature.

<Charging Ability>

(1) 15 Seconds Stirring Q/M 100 parts by mass of a silicon resin coated ferrite carrier (average particle diameter 50 μm) and 4 parts by mass of each toner were placed in a stainless steel pot, up to 30% of unobstructed capacity. The mixture was stirred for 15 minutes at a stirring speed of 100 rpm, and was determined (calculated) by a blow-off method.

(2) 10 Minutes Stirring Q/M

A charging amount when the mixture was stirred for 10 minutes, was determined (calculated) similarly as in (1) mentioned above.

<Overall Evaluation>

The abovementioned evaluation results were observed comprehensively, and evaluated according to the following standards.

A: Favorable

C: Defective (Not acceptable)

TABLE 1

| | | Modified polyester | | | | Toner particle diameter | | | |
|---|---|---|---|---|---|---|---|---|---|
| | Toner No. | Intermediate polyester polymerization catalyst | Tg (° C.) | Weight-average molecular weight | NCO added catalyst | Weight-average particle diameter Dw (μm) | Number-average particle diameter Dn (μm) | Dw/Dn | Toner Tg (° C.) |
| Example 1 | Toner 1 | Ti-based catalyst | 36 | 28000 | Bi-based catalyst | 5.11 | 4.48 | 1.14 | 45.1 |
| Example 2 | Toner 2 | Ti-based catalyst | 34 | 19000 | Bi-based catalyst | 5.22 | 4.58 | 1.14 | 44.5 |
| Example 3 | Toner 3 | Ti-based catalyst | 33 | 11000 | Bi-based catalyst | 5.31 | 4.61 | 1.15 | 44.3 |
| Example 4 | Toner 4 | Ti-based catalyst | 36 | 28000 | Bi-based catalyst | 5.11 | 4.48 | 1.14 | 45.1 |
| Example 5 | Toner 5 | Ti-based catalyst | 34 | 19000 | Bi-based catalyst | 5.22 | 4.58 | 1.14 | 44.5 |
| Example 6 | Toner 6 | Ti-based catalyst | 33 | 11000 | Bi-based catalyst | 5.31 | 4.61 | 1.15 | 44.3 |
| Comparative Example 1 | Toner 7 | Ti-based catalyst | 34 | 19000 | — | 4.92 | 4.32 | 1.14 | 44.6 |
| Comparative Example 2 | Toner 8 | Sn-based catalyst | 34 | 20000 | — | 5.08 | 4.51 | 1.13 | 44.8 |
| Comparative Example 3 | Toner 9 | Ti-based catalyst | 34 | 19000 | — | 4.92 | 4.32 | 1.14 | 44.6 |
| Comparative Example 4 | Toner 10 | Sn-based catalyst | 34 | 20000 | — | 5.08 | 4.51 | 1.13 | 44.8 |

TABLE 2

| | Fixing | | | Charging | | Content in toner (ppm) | | | |
|---|---|---|---|---|---|---|---|---|---|
| | Fixing lower-limit temperature (° C.) | Offset occurrence temperature (° C.) | Temperature resistance preservability | 15 sec | 10 min | Bi | Ti | Sn | Overall evaluation |
| Example 1 | 120 | 210 | A | −5.2 | −13.7 | 150 | 125 | 740 | A |
| Example 2 | 120 | 205 | A | −5.4 | −13.5 | 165 | 130 | 730 | A |

TABLE 2-continued

| | Fixing | | | | | | | | |
|---|---|---|---|---|---|---|---|---|---|
| | Fixing lower-limit temperature | Offset occurrence temperature | Temperature resistance | Charging | | Content in toner (ppm) | | | Overall |
| | (° C.) | (° C.) | preservability | 15 sec | 10 min | Bi | Ti | Sn | evaluation |
| Example 3 | 120 | 200 | A | −6.1 | −14.9 | 145 | 125 | 715 | A |
| Example 4 | 120 | 210 | A | −5.2 | −13.7 | 150 | 125 | 460 | A |
| Example 5 | 120 | 205 | A | −5.4 | −13.5 | 165 | 130 | 450 | A |
| Example 6 | 120 | 200 | A | −6.1 | −14.9 | 145 | 125 | 420 | A |
| Comparative Example 1 | 120 | 165 | A | −6.4 | −14.8 | 0 | 130 | 715 | C |
| Comparative Example 2 | 120 | 200 | A | −5.8 | −12.2 | 0 | 0 | 830 | C |
| Comparative Example 3 | 120 | 165 | A | −6.4 | −14.8 | 0 | 130 | 420 | C |
| Comparative Example 4 | 120 | 200 | A | −5.8 | −12.2 | 0 | 0 | 560 | C |

A: Favorable (Good)
C: Defective (Not favorable)

The toner according to the present invention is capable of having both the excellent low-temperature fixing property and the offset resistance property, and can be suitably used for forming a high quality image. Moreover, the developer according to the present invention in which the toner according to the present invention is used, toner container, the process cartridge, the image forming apparatus, and the image forming method can be suitably used for a high quality electrophotographic image formation.

What is claimed is:

1. A toner, comprising:

a colorant; and a binder resin;

wherein:

the toner is prepared by:

dissolving or dispersing at least the colorant, a precursor of the binder resin having a site capable of reacting with an active hydrogen group-containing compound and the active hydrogen group-containing compound in an organic solvent to prepare a toner constituent mixture liquid;

dispersing or emulsifying the toner constituent mixture liquid in an aqueous medium while subjecting the precursor to a reaction with the active hydrogen group-containing compound to prepare a toner dispersion; and removing the organic solvent from the toner dispersion to prepare the toner;

the binder resin comprises at least a modified polyester;

the modified polyester is derived from the precursor which has an isocyanate-derived functional group;

an Sn content of the toner is 800 ppm or less;

a content of Ti derived from a polyesterified catalyst in the toner is 10 ppm to 200 ppm; and a content of Bi derived from an isocyanated catalyst in the toner is 10 ppm to 200 ppm.

2. The toner according to claim 1, wherein:

the Sn content is 0 ppm to 500 ppm;

the content of Ti derived from the polyesterified catalyst is 10 ppm to 200 ppm; and the content of Bi derived from the isocyanated catalyst is 10 ppm to 200 ppm.

3. The toner according to claim 1, wherein the binding site derived from the isocyanate group is at least one of a urea bond and a urethane bond.

4. The toner according to claim 1, wherein:

the modified polyester comprises an isocyanate terminal modified polyester; and the isocyanate terminal modified polyester is prepared by reacting an unmodified polyester with a diisocyanate compound in the presence of the isocyanated catalyst.

5. The toner according to claim 4, wherein the unmodified polyester consists of uncrosslinkable components.

6. The toner according to claim 4, wherein the isocyanate terminal modified polyester has a ratio (NCO/OH) of a number of OH groups of the unmodified polyester relative to a number of NCO groups of the diisocyanate compound of from 2.0 to 2.5.

7. The toner according to claim 1, wherein the unmodified polyester is polymerized using the polyesterified catalyst.

8. The toner according to claim 1, wherein the toner comprises a crosslinkable polyester.

9. The toner according to claim 8, wherein the crosslinkable polyester is formed by a reaction between the modified polyester and the active hydrogen group-containing compound.

10. The toner according to claim 1, wherein:

the toner comprises a binder resin which differs from the polymer having a site capable of reacting with at least the active hydrogen group-containing compound; and the glass transition temperature of the binder resin is 30° C. to 50° C.

11. The toner according to claim 10, wherein the binder resin has an acid value of 1 mg KOH/g to 30 mg KOH/g.

12. The toner according to claim 1, wherein the toner has a glass transition temperature of 40° C. to 70° C.

13. The toner according to claim 1, wherein:

a weight average particle diameter of the toner is 3 μm to 8 μm; and a ratio of the weight average particle diameter of the toner to a number average particle diameter of the toner is 1.25 or less.

14. A process cartridge comprising:

a latent electrostatic image bearing member; and a developing unit configured to develop a latent electrostatic image formed on the latent electrostatic image bearing member using a toner to form a visible image;

wherein:

the toner is prepared by:

dissolving or dispersing at least a colorant, a precursor of a binder resin having a site capable of reacting with an active hydrogen group-containing, compound and the active hydrogen group-containing compound in an organic solvent to prepare a toner constituent mixture liquid;

dispersing or emulsifying the toner constituent mixture liquid in an aqueous medium while subjecting the precursor to a reaction with the active hydrogen group-containing compound to prepare a toner dispersion; and removing the organic solvent from the toner dispersion to prepare the toner;

the binder resin comprises at least a modified polyester;

the modified polyester is derived from the precursor which has an isocyanate-derived functional group;

an Sn content of the toner is 800 ppm or less;

a content of Ti derived from a polyesterified catalyst in the toner is 10 ppm to 200 ppm; and a content of Bi derived from an isocyanated catalyst in the toner is 10 ppm to 200 ppm.

15. An image forming method comprising:

forming a latent electrostatic image on a latent electrostatic image bearing member;

developing the latent electrostatic image using a toner to form a visible image;

transferring the visible image onto a recording medium; and fixing the image transferred to the recording medium;

wherein:

the toner is prepared by:

dissolving or dispersing at least a colorant, a precursor of the binder resin having a site capable of reacting with an active hydrogen group-containing and the active hydrogen group-containing compound in an organic solvent to prepare a toner constituent mixture liquid;

dispersing or emulsifying the toner constituent mixture liquid in an aqueous medium while subjecting the precursor to a reaction with the active hydrogen group-containing compound to prepare a toner dispersion; and removing the organic solvent from the toner dispersion to prepare the toner;

the binder resin comprises at least a modified polyester;

the modified polyester is derived from the precursor which has an isocyanate-derived functional group;

an Sn content of the toner is 800 ppm or less;

a content of Ti derived from a polyesterified catalyst in the toner is 10 ppm to 200 ppm; and a content of Bi derived from an isocyanated catalyst in the toner is 10 ppm to 200 ppm.

* * * * *